United States Patent [19]

Benge et al.

[11] Patent Number: 5,006,856

[45] **Date of Patent: * Apr. 9, 1991**

[54] ELECTRONIC ARTICLE SURVEILLANCE TAG AND METHOD OF DEACTIVATING TAGS

[75] Inventors: S. Eugene Benge, Middletown; Robert L. Froning, Kettering, both of Ohio

[73] Assignee: Monarch Marking Systems, Inc., Dayton, Ohio

[ * ] Notice: The portion of the term of this patent subsequent to Oct. 18, 2005 has been disclaimed.

[21] Appl. No.: 397,804

[22] Filed: Aug. 23, 1989

[51] Int. Cl.[5] ..... G08B 13/14

[52] U.S. Cl. ..... 340/572

[58] Field of Search ..... 340/572; 343/894, 895

[56] References Cited

U.S. PATENT DOCUMENTS 4,778,552 10/1988 Benge et al. ..... 340/572
4,792,790 12/1988 Reeb ..... 340/572
4,802,944 2/1989 Benge ..... 340/572
4,818,312 4/1989 Benge ..... 340/572
4,846,922 7/1989 Benge et al. ..... 340/572

*Primary Examiner*—Joseph A. Orsino
*Assistant Examiner*—Geoff Sutcliffe
*Attorney, Agent, or Firm*—Joseph J. Grass

[57] ABSTRACT

A deactivatable tag useable with an electronic article surveillance system and method of making such a tag. The tag includes a resonant circuit and a provision for promoting the permanent deactivation of the tag. The solution according to the present invention has been to render the deactivator more difficult to operate. A higher level of excess energy is applied to the resonant circuit before the breakdown material breaks down. This higher level of energy in the resonant circuit is applied to the improved deactivator and operates the deactivator much more completely. This arrangement promotes permanent deactivation of the resonant circuit to prevent the resonant circuit from becoming active again or "coming back to life" as time passes. The deactivator adjacent the resonant circuit can include a vacuum metalized conductive coating.

18 Claims, 16 Drawing Sheets

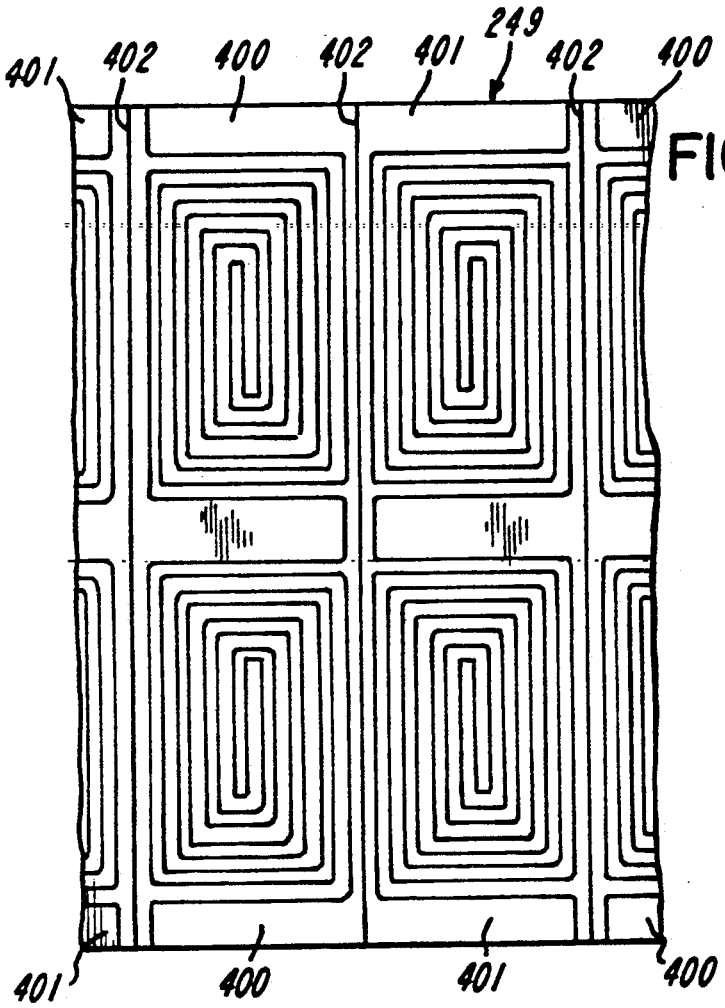
FIG-22
FIG-23
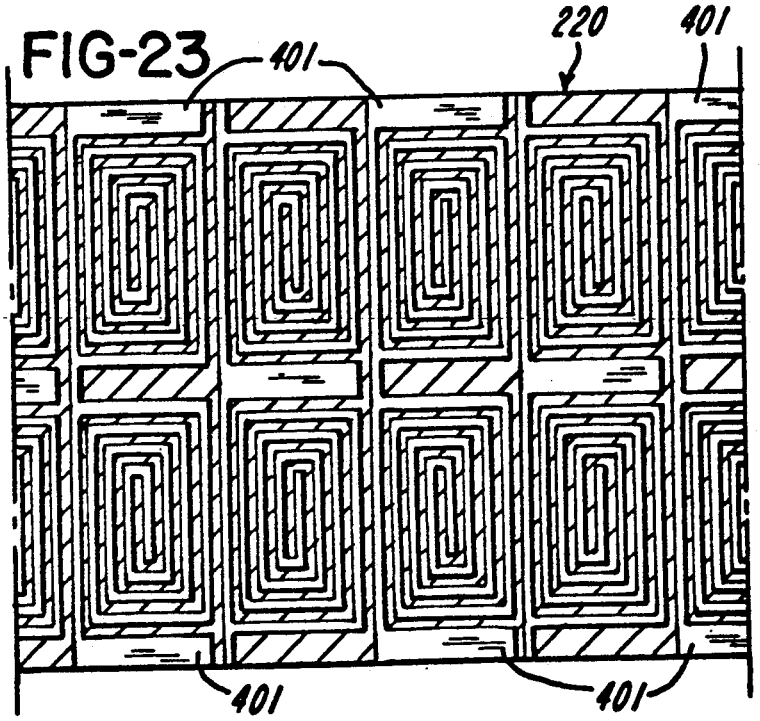

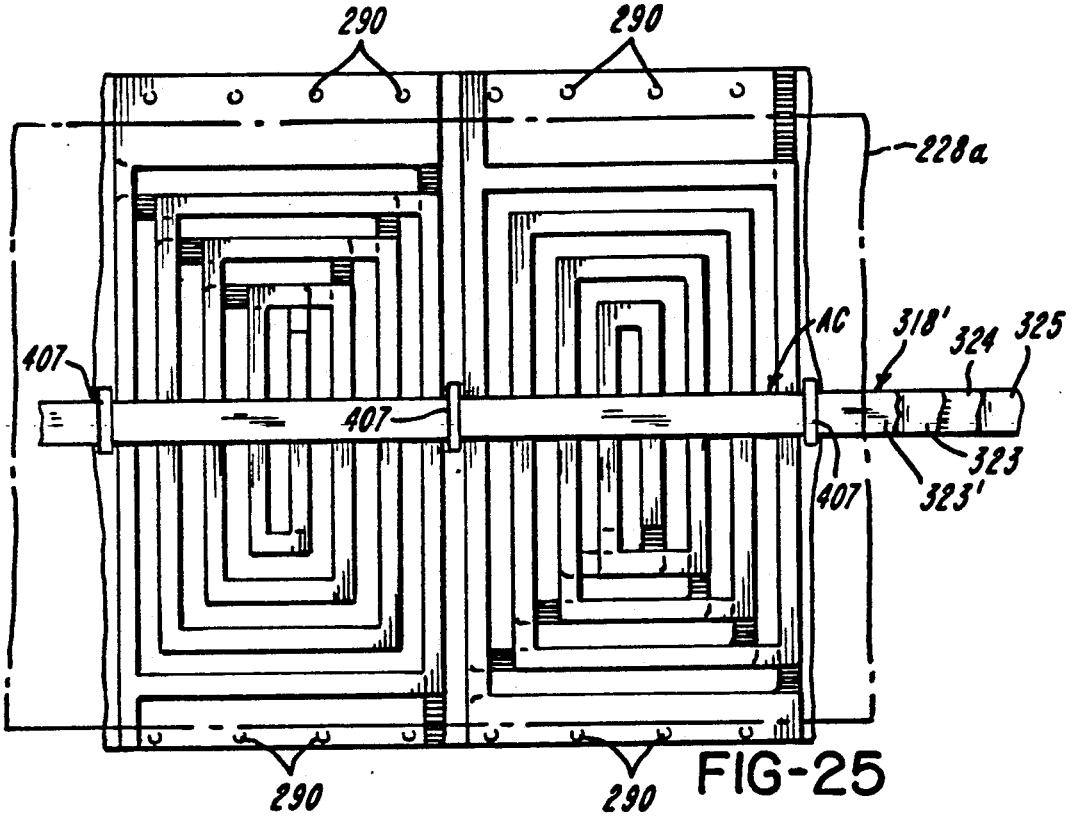
FIG-25
FIG-24
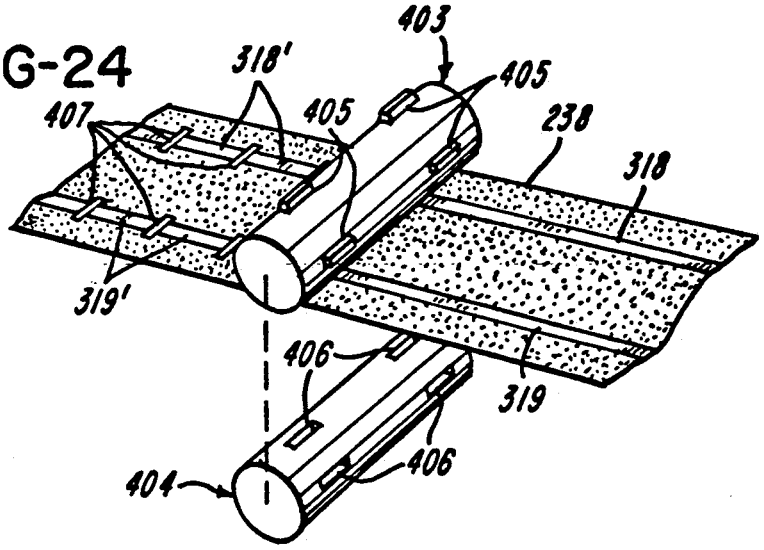

TL
AC3
TL
AC1
TL
400
400c
T
401c
T
RC
503
401-1
401-2
401-3
228a
401
401-1
401-4
401-5
RC
401-2
AC2
401-3
520
520
AC3
32
32
ACW
AC1
AC2
AC
401-6
AC
401-4
401-7
401-5
401-8
401
1
2
3
4
5
6
7
8
1
2
3
4
5
6
7
8
401-6
401-7
401-8
520
400c
400
503

526
525
520
527
524
525
526
37
523
AC1
401
523
522
521
528
522
521
401
AC2

ELECTRONIC ARTICLE SURVEILLANCE TAG AND METHOD OF DEACTIVATING TAGS

BACKGROUND OF THE INVENTION

1. Field of the Invention

This invention relates to the art of resonant tags used in electronic article surveillance systems and to method of making such tags.

2. Brief Description of the Prior Art

U.S. Pat. No. 4,717,438 to S. Eugene Benge and Robert L. Froning granted Jan. 5, 1988 is made of record.

The deactivatable tags according to the embodiments of FIGS. 19, 20, 25, 27, 28 and 30 in U.S. Pat. No. 4,818,312 are admitted to be prior art.

SUMMARY OF THE INVENTION

This invention relates to an improved method of making permanently deactivatable tags for use in an electronic article surveillance system and to improved tags per se.

Prior art deactivatable electronic article surveillance tags referenced above are normally deactivated by applying excessive energy to the resonant circuit. Excess energy in the resonant circuit causes a normally non-conductive breakdown material of a deactivator to become conductive which in turn renders the resonant circuit undetectable. It has been found that such prior art deactivatable tags are not always permanently deactivated. It is believed that the reason for this is that the excess energy applied to the resonant circuit is not high enough to always cause complete enough breakdown of the breakdown material. It has been found that, over time, some of the tags which were once deemed to be deactivated, became detectable again.

The solution according to the present invention has been to render the deactivator more difficult to operate. A higher level of excess energy is applied to the resonant circuit before the breakdown material breaks down. This higher level of energy in the resonant circuit is applied to the improved deactivator and operates the deactivator much more completely. This arrangement promotes permanent deactivation of the resonant circuit to prevent the resonant circuit from becoming active again or "coming back to life" as time passes.

It is commercially practical to apply the deactivator in web form to the web of tags as the tag web is being produced. This is preferred over applying a short deactivator strip to each resonant circuit.

In accordance with a specific embodiment of this invention, a deactivator web is applied across the entire length of the tag web. The deactivator web associated with each tag is preferably separated into three portions or sections. These sections are electrically separated from each other. In the preferred embodiment, each resonant circuit includes a spiral conductor having eight spaced conductor portions arranged along a straight line. The deactivator web associated with each resonant circuit is preferably separated between the first and second conductor portions and also between the seventh and eighth conductor portions. The deactivator effectively comprises only that deactivator section associated with the second through the seventh conductor portions. The deactivator sections associated respectively with the first and eighth conductor portions are essentially ineffective to deactivate the resonant circuit. However, when sufficient excessive energy is applied to the resonant circuit to operate the deactivator (associated with the second through seventh conductor portions) the relatively high amount of energy applied to the deactivator causes effective deactivation of the resonant circuit on a permanent basis.

It is another object of the invention to provide an improved deactivator having a normally non-conductive breakdown coating and a conductor for rendering the resonant circuit ineffective to be detected by the electronic article surveillance system, wherein the conductor is made extremely thin so that shielding of the resonant circuit is at a minimum.

In accordance with a specific embodiment, the conductor of the deactivator is deposited by a vacuum metalizing process or by a sputtering process which results in an extremely small amount of conductive material being deposited on the carrier for the deactivator.

It is still another object of the invention to provide an improved arrangement for preventing the premature deactivation of a permanent circuit or a series of resonant circuits in a tag web due to electrostatic discharge. This object is carried out preferably by means disposed within the periphery of the resonant circuit. In particular, the deactivator can be comprised of a deactivator strip having breakdown material. The deactivator strip is preferably separated between at least one pair of adjacent turns into deactivator sections so that under conditions of manufacture and use the tag web does not deactivate prematurely due to electrostatic discharge. The provision of making the separation within the periphery of the resonant circuit lessens the capability of the resonant circuit to contribute to deactivation due to electrostatic discharge.

BRIEF DESCRIPTION OF THE DRAWINGS

FIG. 22 is a top plan view of an alternative cut pattern for the web of conductive material corresponding generally to D in FIG. 5;

FIG. 23 is a top plan view of the alternative cut pattern with one-half of the conductive material removed and corresponding generally to G in FIG. 6;

FIG. 24 is a diagrammatic perspective view showing the manner in which the webs of deactivating material are cut into stripes or strips;

FIG. 25 is a top plan view of a pair of longitudinally spaced resonant circuits with separate respective deactivator strips;

DESCRIPTION OF THE PREFERRED EMBODIMENTS

Figure 1:
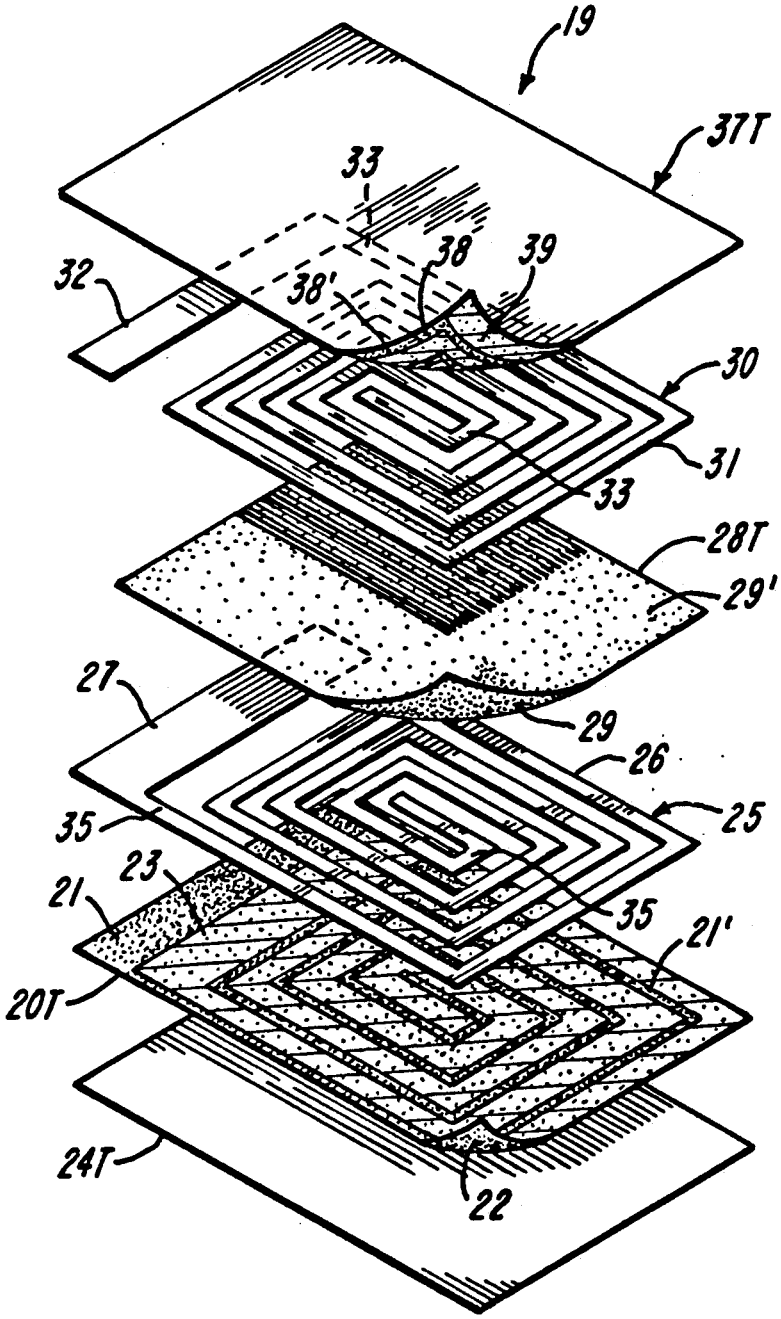
FIG. 1 is an exploded perspective view of a tag in accordance with an embodiment of the invention.

Referring initially to FIG. 1, there is shown an exploded view of a tag generally indicated at 19. The tag 19 is shown to include a sheet 20T having pressure sensitive adhesive 21 and 22 on opposite faces thereof. A mask 23 in a spiral pattern covers a portion of the adhesive 21 and a release sheet 24T is releasably adhered to the adhesive 22. The mask 23 renders the adhesive 21 which it covers non-tacky or substantially so. A conductor spiral indicated generally at 25 includes a spiral conductor 26 having a number of turns. The conductor 26 is of substantially the same width throughout its length except for a connector bar 27 at the outer end portion of the conductor spiral 26. There is a sheet of dielectric 28T over and adhered to the conductor spiral 25 and the underlying sheet 20T by means of adhesive 29. A conductor spiral generally indicated at 30 includes a spiral conductor 31 having a number of turns. The conductor 31 is adhered to adhesive 29' on the dielectric 28T. The conductor 31 is substantially the same width throughout its length except for a connector bar 32 at the outer end portion of the conductor spiral 30. The conductor spirals 25 and 30 are generally aligned in face-to-face relationship except for portions 33 which are not face-to-face with the conductor 26 and except for portions 35 which are not face-to-face with the conductor 31. A sheet 37T has a coating of a pressure sensitive adhesive 38 masked off in a spiral pattern 39. The exposed adhesive 38' is aligned with the conductor spiral 30. Adhesive is shown in FIG. 1 by heavy stippling and the masking is shown in FIG. 1 by light stippling with cross-hatching. The connector bars 27 and 32 are electrically connected, as for example by staking 90. It should be noted that the staking 90 occurs where connector bars 27 and 32 are separated only by adhesive 29. There is no paper, film or the like between the connector bars 27 and 32. Accordingly, the staking disclosed in the present application is reliable.

Figure 2:
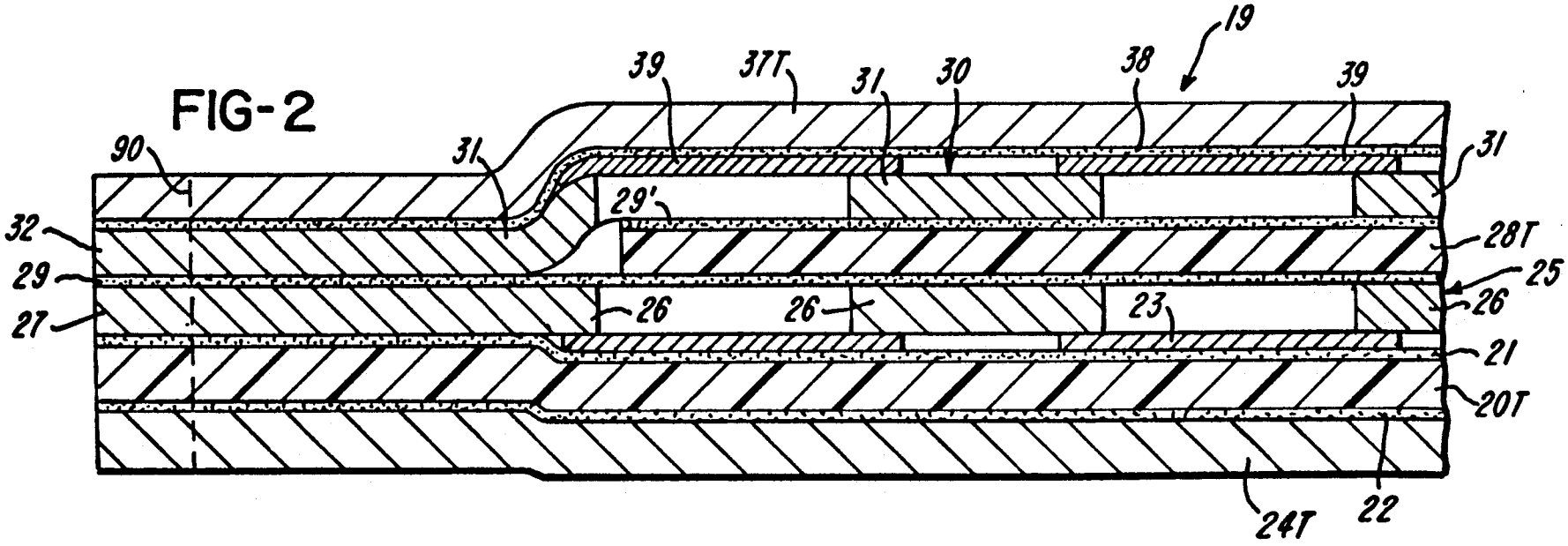
FIG. 2 is a fragmentary sectional view of the tag shown in FIG. 1.
Figure 3:
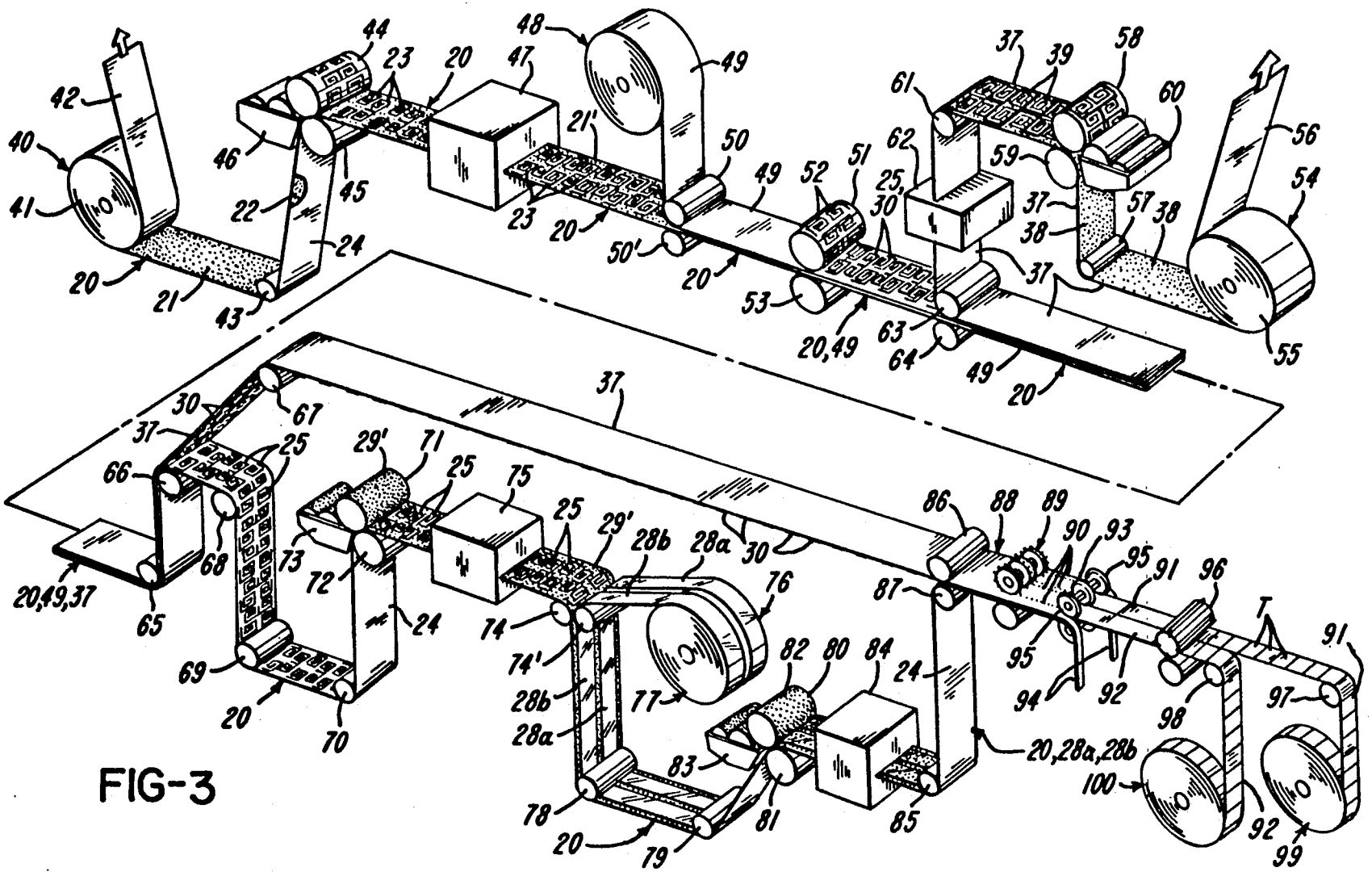
FIG. 3 is a diagrammatic perspective view illustrating method of making a tag in accordance with the invention.
Figure 4:
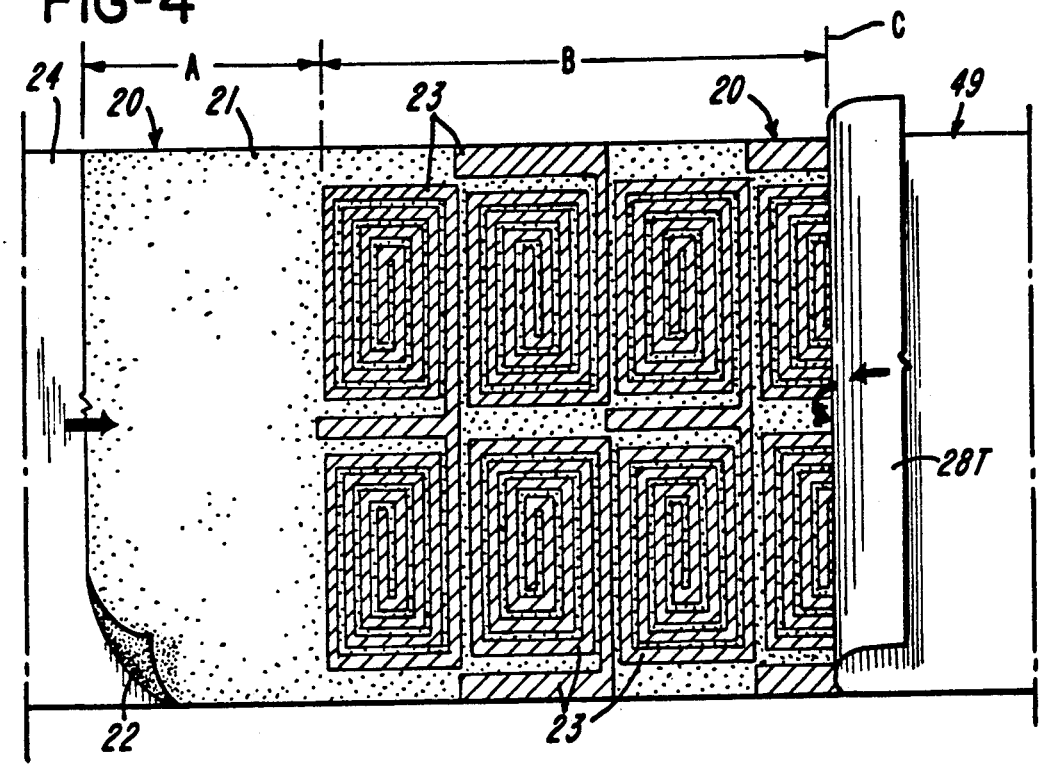
FIG. 4 is a diagrammatic top plan view showing a mask having been applied to a first adhesive coated web and showing an electrically conductive web being laminated to the masked first adhesive coated web.
Figure 5:
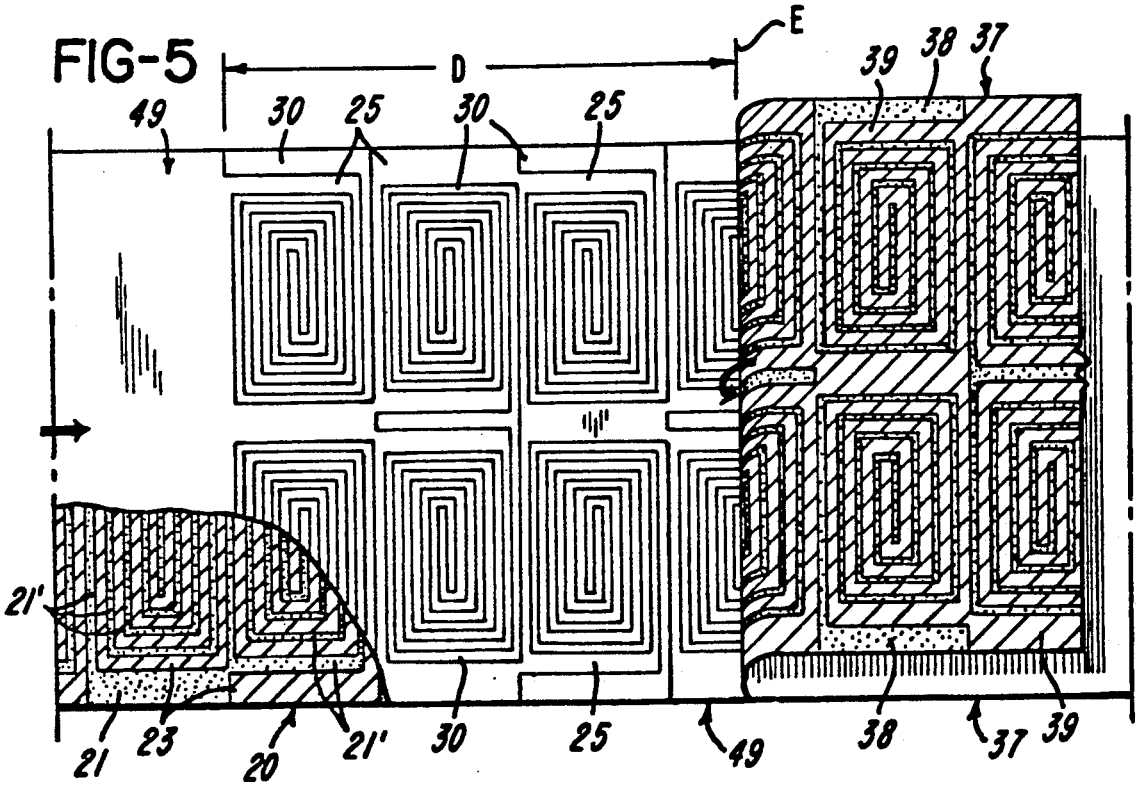
FIG. 5 is a diagrammatic top plan view showing the conductive web having been cut to provide first and second pairs of conductors and showing a masked second adhesive coated web being laminated to the conductive web.

With reference to FIG. 3, there is shown diagrammatically a method for making the tag 19 shown in FIGS. 1 and 2. A roll 40 is shown to be comprised of a composite web 41 having a web 20 with a full-gum or continuous coatings of pressure sensitive adhesive 21 and 22 on opposite faces thereof. The web 20 is "double-faced" with adhesive. A release liner or web 42 is releasably adhered to the upper side of the web 20 by the pressure sensitive adhesive 21, and the underside of the web 20 has a release liner or web 24 releasably adhered to the pressure sensitive adhesive 22. As shown, the release liner 42 is delaminated from the web 20 to expose the adhesive 21. The adhesive coated web 20 together with the release liner 24 pass partially about a sandpaper roll 43 and between a pattern roll 44 and a back-up roll 45 where mask patterns 23 are applied onto the adhesive 21 to provide longitudinally recurring adhesive patterns 21'. Masking material from a fountain 46 is applied to the pattern roll 44. With reference to FIG. 4, the portion marked A represents the portion of the web 20 immediately upstream of the pattern roll 44. The portion marked B shows the mask patterns 23 printed by the roll 44. The patterns 23 are represented by cross-hatching in FIG. 4. With reference to FIG. 3, the web 20 now passes through a dryer 47 where the mask patterns 23 are dried or cured. The adhesive 21 is rendered non-tacky at the mask patterns 23. A web 49 of planar, electrically conductive material such as copper or aluminum from a roll 48 is laminated onto the coated web 20 as they pass between laminating rolls 50 and 50'. Reference character C in FIG. 4 denotes the line where lamination of the webs 20 and 49 occurs. With reference to FIG. 3, the laminated webs 20 and 49 now pass between a cutting roll 51 having cutting blades 52 and a back-up roll 53. The blades 52 cut completely through the conductive material web 49 but preferably do not cut into the web 20. The blades 52 cut the web 49 into a plurality of series of patterns 25 and 30 best shown in the portion marked D in FIG. 5. With reference again to FIG. 3, there is shown a roll 54 comprised of a composite web 55 having a web 37 with a full-gum or continuous coating of pressure sensitive adhesive 38 and a release liner 56 releasably adhered to the adhesive 38 on the web 37. The release liner 56 is separated from the web 37 and the web 37 passes about a sandpaper roll 57. From there the web 37 passes between a pattern roll 58 and a back-up roll 59 where mask patterns 39 are applied onto the adhesive 38 to render the adhesive 38 non-tacky at the mask patterns 39 to provide longitudinally recurring adhesive patterns 38' (FIG. 1). Masking material from a fountain 60 is applied to the pattern roll 58. The masking material of which the patterns 23 and 39 are comprised is a commercially available printable adhesive deadener such as sold under the name "Aqua Superadhesive Deadener" by Environmental Inks and Coating Corp, Morganton, N.C. From there the web 37 passes partially about a roll 61 and through a dryer 62 where the mask patterns 39 are dried or cured. The adhesive 38 is rendered non-tacky at the mask patterns 39. From there the webs 20, 49 and 37 pass between laminating rolls 63 and 64. FIG. 5 shows that lamination occurs along line E where the web 37 meets the web 49. When thus laminated, each adhesive pattern 21' registers only with an overlying conductor spiral 25 and each adhesive pattern 38' registers only with an underlying conductor spiral 30.

Figure 6:
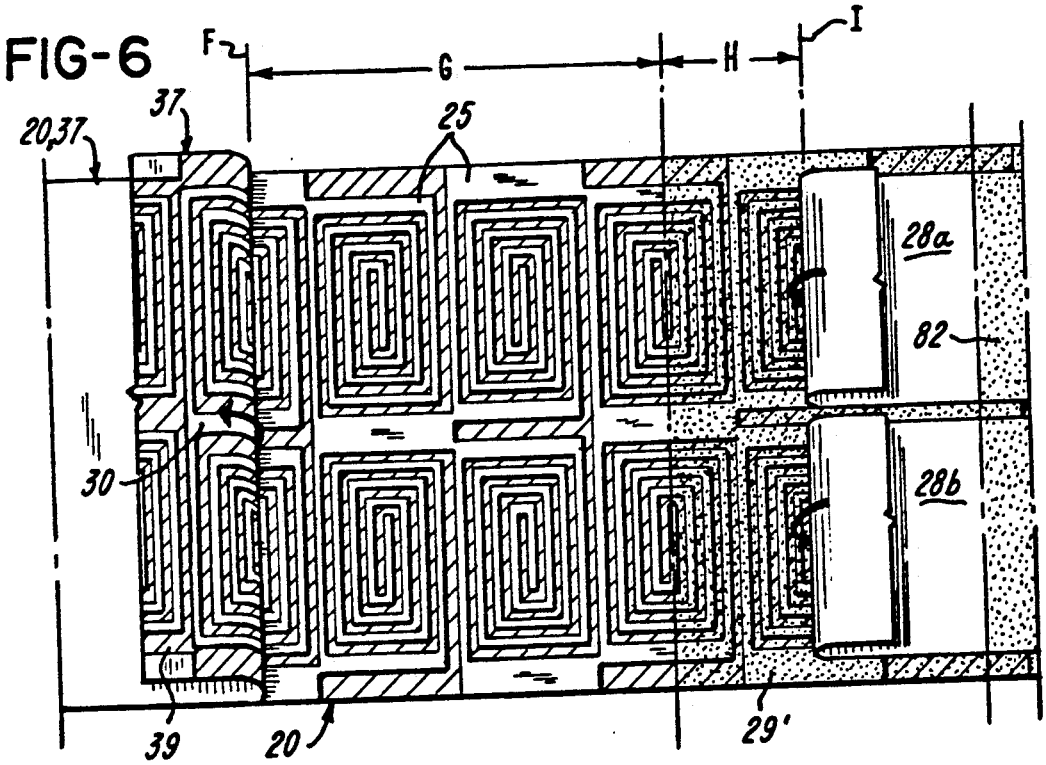
FIG. 6 is a diagrammatic top plan view showing the first coated web with the first conductors adhered thereto being separated relative to the second coated web with the second conductors adhered thereto, and showing further the first coated web having been recoated with adhesive and two webs of dielectric being laminated to the recoated first coated web, and showing the dialectric webs having been coated with adhesive.

The webs 20, 37 and 49 pass successively partially about rolls 65 and 66 and from there the web 37 delaminates from the web 20 and passes partially about a roll 67. At the place of delamination, the web 49 separates into two webs of conductor spirals 25 and 30. As shown in FIG. 6, delamination occurs along the line marked F. When delamination occurs, the conductor spirals 30 adhere to the adhesive patterns 38' on the web 37, and the conductor spirals 25 adhere to the adhesive patterns 21' on the web 20. Thus, the conductor spirals 30 extend in one web and the spirals 25 extend in another web. The web 20 passes partially about rolls 68, 69 and 70 and from there pass between an adhesive coating roll 71 and a back-up roll 72. Adhesive 29 from a fountain 73 is applied to the roll 71 which in turn applies a uniform or continuous coating of adhesive 29 to the web 20 and over conductive spirals 25. The portion marked G in FIG. 6 shows the portion of the web 20 and conductor spirals 25 between the spaced rolls 66 and 72. The portion marked H shows the portion of the web 20 between the spaced rolls 72 and 74. With reference to FIG. 3, the web 20 passes through a dryer 75 where the adhesive 29 is dried. A plurality, specifically two laterally spaced dialectric webs **28*a* and 28*b* wound in rolls 76 and 77 are laminated to the web 20 as the webs 20, 28*a* and 28*b* pass between the rolls 74 and 74'. This laminating occurs along reference line I indicated in FIG. 6. With reference to FIG. 3, the web 20 with the conductor spirals 25 and the dialectric webs 28*a* and 28*b* pass about rolls 78 and 79 and pass between an adhesive applicator roll 80 and a back-up roll 81. The roll 80 applies adhesive 29' received from a fountain 83 to the webs 28*a* and 28*b* and to the portions of the web 20 not covered thereby. From there, the webs 20, 28*a* and 28*b* pass through a dryer 84 and partially about a roll 85**.

Figure 7:
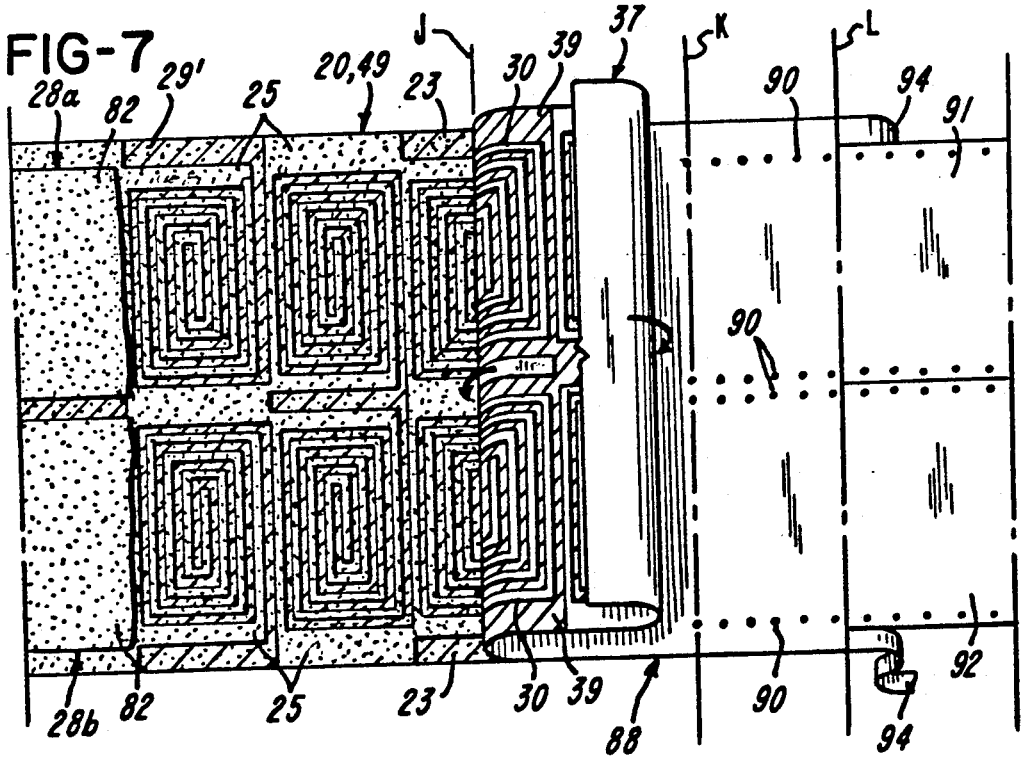
FIG. 7 is a diagrammatic top plan view showing the second coated web with the second conductors adhered thereto having been shifted and laminated over and to the dialectric webs and to the first coated web with the first conductors to provide a composite tag web, showing the staking of the first and second conductors of each tag to provide resonant circuits for each tag, and showing slitting of the composite tag web to provide a plural series of composite tag webs.

The web 37 which had been separated from the web 20 is laminated at the nip of laminating rolls 86 and 87 along a line marked J in FIG. 7 to provide a composite tag web generally indicated at 88. The webs 20, **28*a*, 28*b* and 37 are laminated between rolls 86 and 87 after the conductor spirals 30 have been shifted longitudinally with respect to the conductor spirals 25 so that each conductor spiral 30 is aligned or registered with an underlying conductor spiral 25. The shifting can be equal to the pitch of one conductor spiral pattern as indicated at p (FIG. 9) plus the width w of one conductor, or by odd multiples of the pitch p plus the width w of one conductor. Thus, each pair of conductor spirals 25 and 30** is capable of making a resonant circuit detectable by an appropriate article surveillance circuit.

Figure 8:
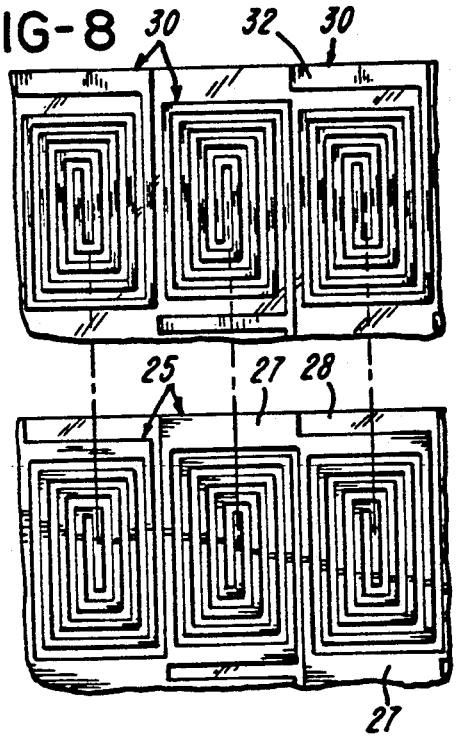
FIG. 8 is a vertically exploded view showing the first and second coated webs with the first and second conductors that result from cutting the electrically conductive web spirally.
Figure 9:
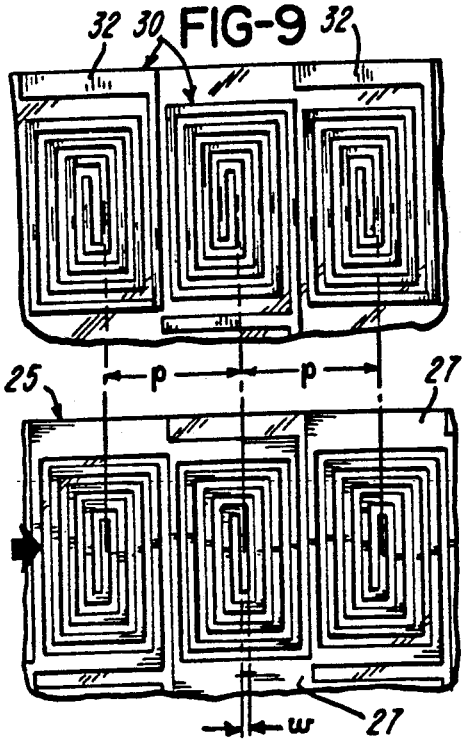
FIG. 9 is a top plan view showing the first and second coated webs shifted by a distance equal to the width of one conductor spiral plus the width of one conductor.
Figure 10:
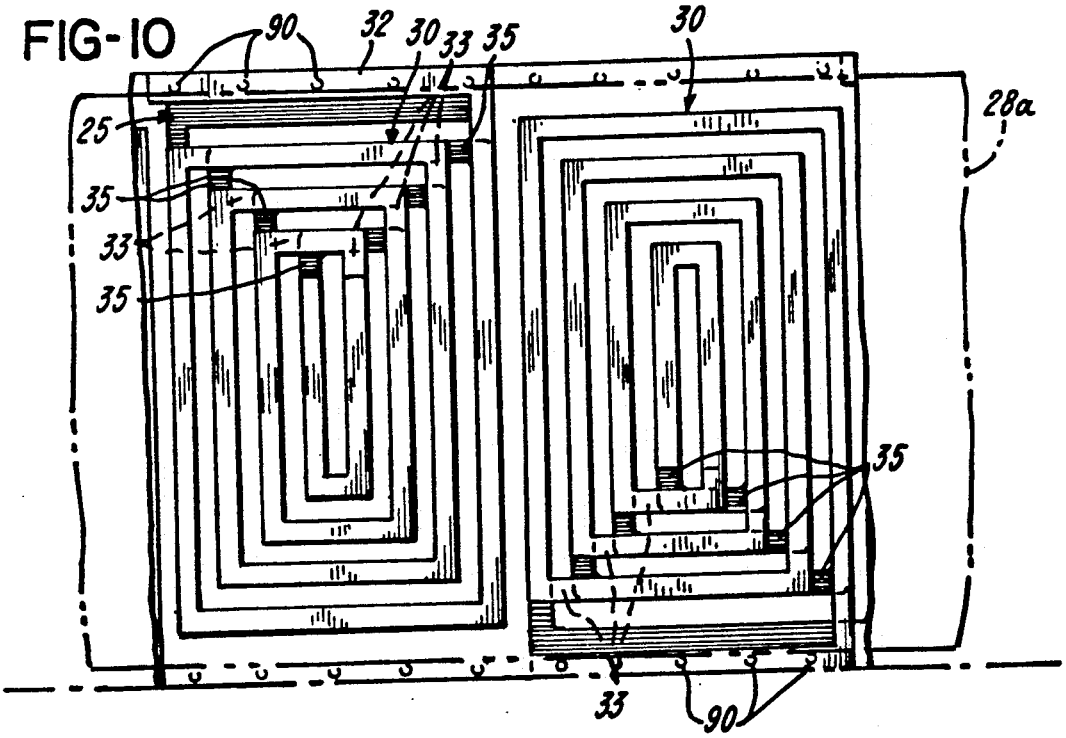
FIG. 10 is a top plan view of two tags with the dielectric web shown in phantom lines.

FIG. 8 shows the web 20 and the web 37 rotated apart by 180°. FIG. 9 shows the web 20 and the web 37 rotated apart by 180° and as having been shifted with respect to each other so that the conductor spirals 25 and 30 are aligned. As best shown in FIG. 10, the dialectric **28*a* terminates short of stakes 90 resulting from the staking operation. By this arrangement the stakes 90 do not pass through the dielectric 28*a* (or 28*b*). FIG. 10 shows the conductor spirals 25 and 30 substantially entirely overlapped or aligned with each other, except as indicated at 35 for the conductor spiral 25 and as indicated at 33 for the conductor spiral 30. Each circuit is completed by staking the conductor bars 27 and 32 to each other as indicated at 90 or by other suitable means. The staking 90 is performed by four spiked wheels 89 which make four stake lines 90 in the composite web 88. The spiked wheels 89 pierce through the conductor bars 27 and 32 and thus bring the conductor bars 27 and 32 into electrically coupled relationship. The web composite 88 is slit into a plurality of narrow webs 91 and 92 by slitter knife 93 and excess material 94 is trimmed by slitter knives 95. The webs 91 and 92 are next cut through up to but not into the release liner 24 by knives on a cutter roll 96, unless it is desired to cut the tags T into separated tags in which event the web 88 is completely severed transversely. As shown, the webs 91 and 92 continue on and pass about respective rolls 97 and 98 and are wound into rolls 99 and 100. As shown in FIG. 7, the staking 90** takes place along a line marked K and the slitting takes place along a line marked L.

The sheet 37T, the dialectric 28T, the sheet 20T and the sheet 24T are respectively provided by cutting the web 37, the web **28*a* (or 28*b*), the web 20 and the web 24**.

Figure 11:
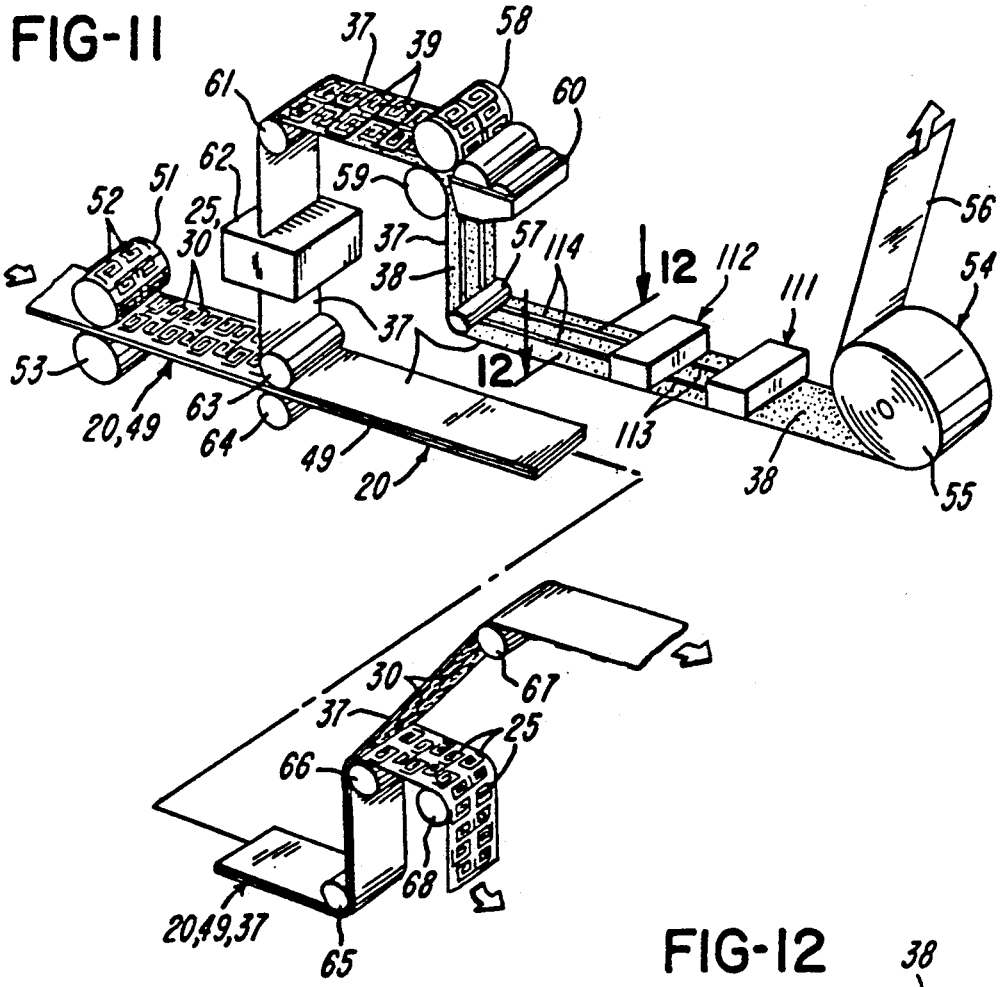
FIG. 11 is a fragmentary perspective view which, when taken together with the preceding figures of the drawings, illustrates an improved method of making deactivatable tags.
Figure 12:
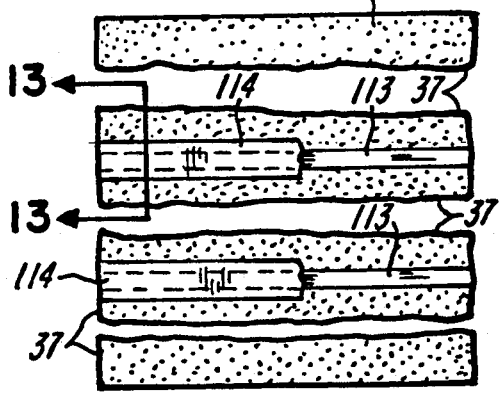
FIG. 12 is a fragmentary top plan view taken along line 12—12 of FIG. 11.
Figure 13:
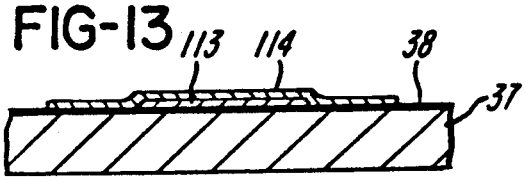
FIG. 13 is a sectional view taken along line 13—13 of FIG. 12.

FIG. 11 is essentially a duplicate of a portion of FIG. 3, but a pair of coating and drying stations generally indicated at 111 and 112 where respective coatings 113 and 114 in the form of continuous stripes are printed and dried. The coating 113 is conductive and is applied directly onto the pressure sensitive adhesive 38 on the web 37. The coatings 114 are wider than the respective coatings 113 which they cover to assure electrical isolation, as best shown in FIGS. 12 and 13. The coatings 114 are composed of a normally non-conductive activatable material. The remainder of the process is the same as the process taught in connection with FIGS. 1 through 10.

Figure 14:
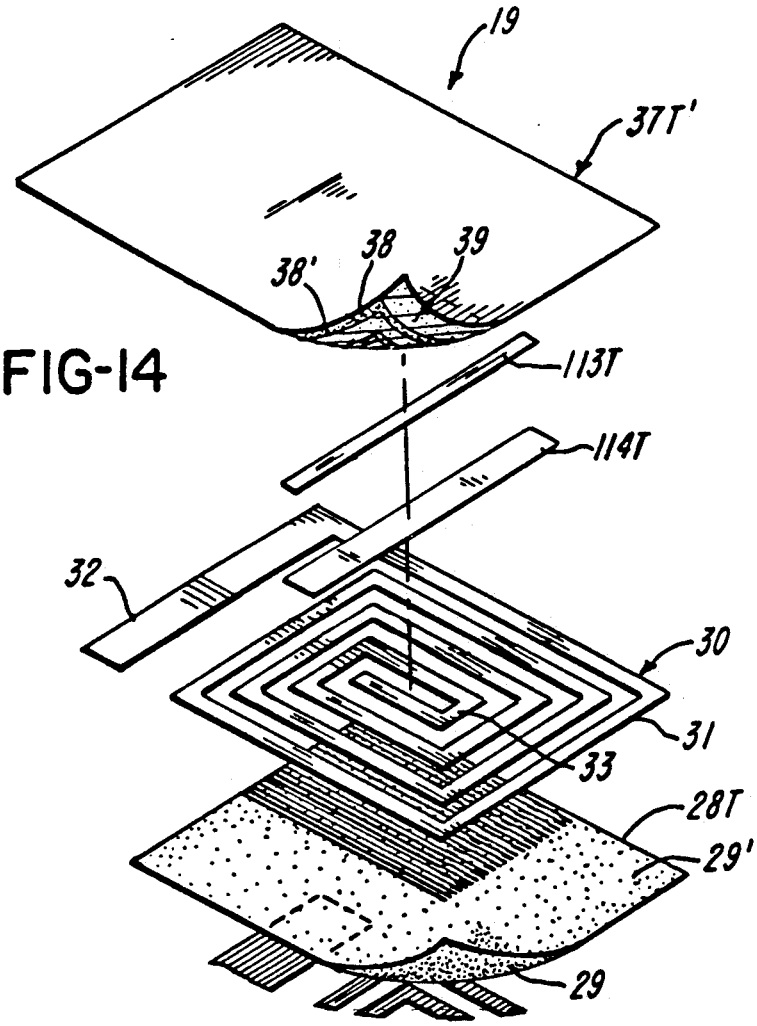
FIG. 14 is a fragmentary perspective view similar to FIG. 1, but showing one embodiment of structure for deactivating the tag.
Figure 15:
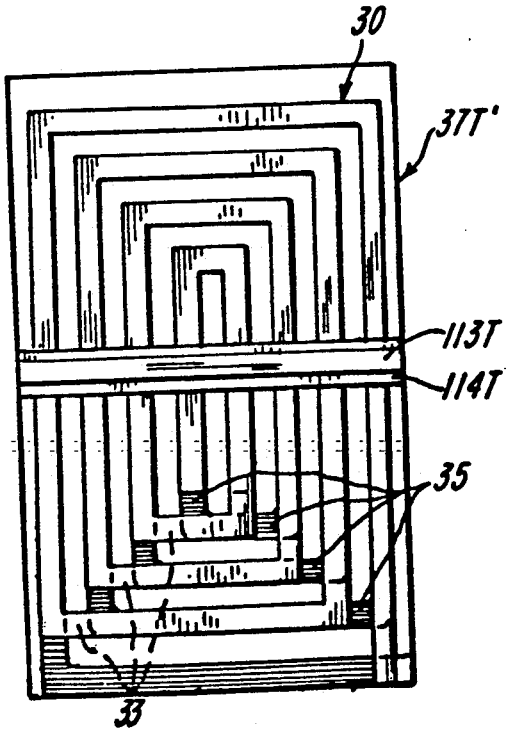
FIG. 15 is a fragmentary top plan view of the tag shown in FIG. 14.

With reference to FIGS. 14 and 15, there is shown a fragment of the finished tag 37T' with the coatings 113 and 114 having been severed as the tag 37T' is severed from the tag web as indicated at 113T and 114T respectively. As shown the coating 113T is of constant width and thickness throughout its length and the coating 114T is of constant width and thickness but is wider than the coating 113T. The coating 113T which is conductive is thus electrically isolated from the conductor spiral 30. The coatings 113T and 114T comprise an activatable connection AC which can be activated by subjecting the tag to a high level of energy above that for causing the resonant circuit to be detected at an interrogation zone.

Figure 16:
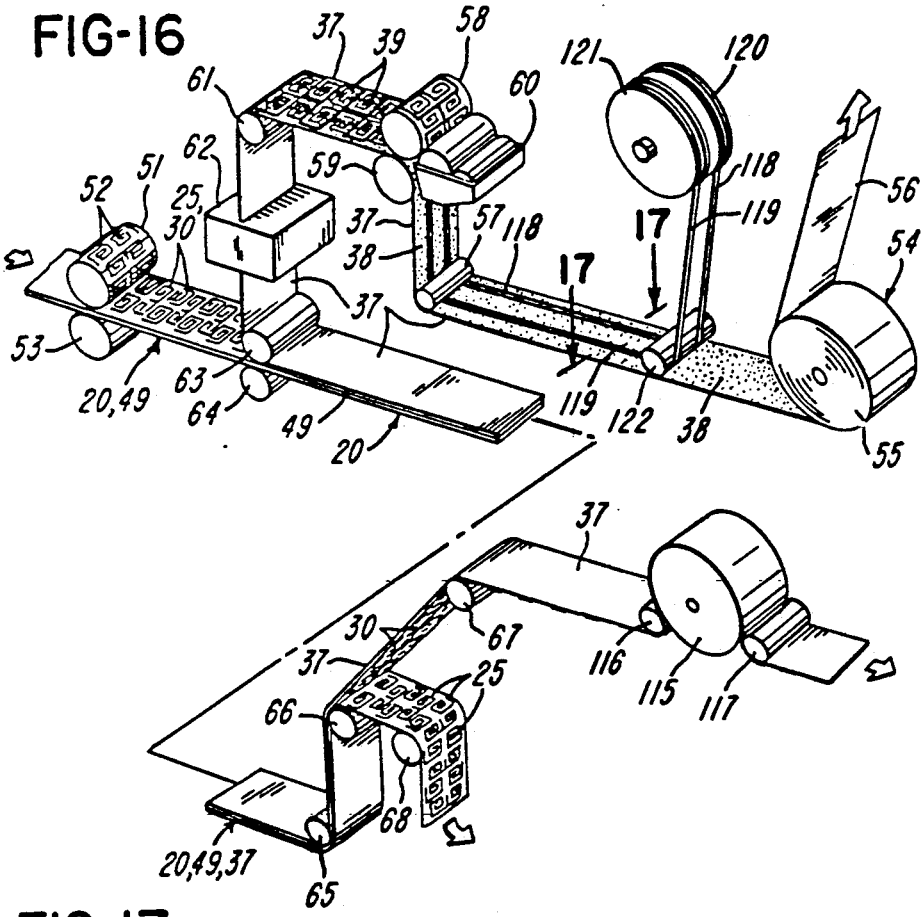
FIG. 16 is a fragmentary perspective view which, taken together with FIGS. 1 through 10, illustrated an alternative improved method of making deactivatable tags.
Figure 17:
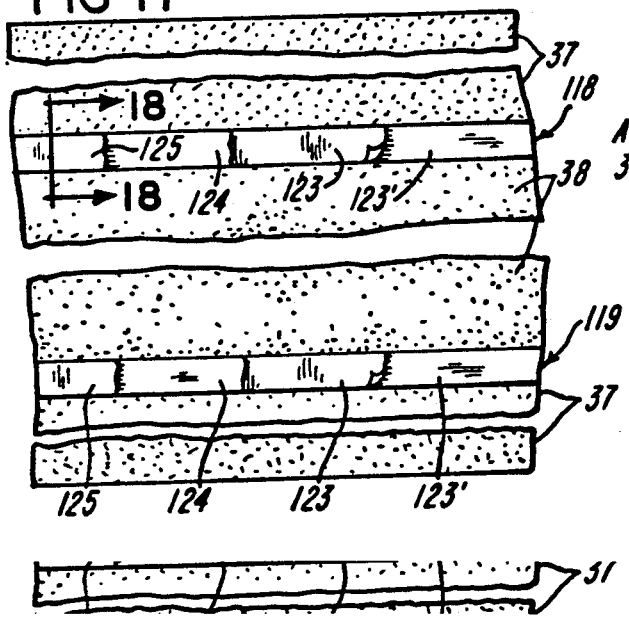
FIG. 17 is a fragmentary top plan view taken along line 17—17 of FIG. 16.
Figure 18:
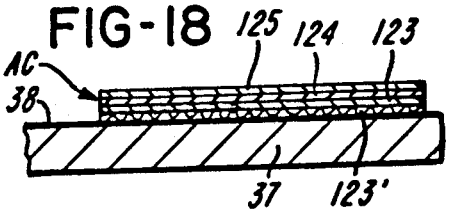
FIG. 18 is a sectional view taken along line 18—18 of FIG. 17.

FIG. 16 is essentially a duplicate of a portion of FIG. 3, but a pair of webs 118 and 119 are adhered to the adhesive 38 on the web 37. The webs 118 and 119 are wound onto spaced reels 120 and 121. The webs 118 and 119 pass from the reels 120 and 121 partially about a roll 122. The webs 118 and 119 are spaced apart from each other and from the side edges of the web 37. The webs 118 and 119 are identical in construction, and each includes a thin layer of conductive material 123 such as copper or aluminum on a layer of paper 123', a high temperature, normally non-conductive, activatable, conductor-containing layer 124, and a low temperature, normally non-conductive, activatable, conductor-containing layer 125. The layers 124 and 125 contain conductors such as metal particles or encapsulated carbon. The layer 125 bonds readily when heated, so a drum heater 115 is positioned downstream of the roll 67 (FIGS. 3 and 16) and upstream of the rolls 86 and 87 (FIG. 3). The heated circuits 30, heat the layer 125 and a bond is formed between the circuits 30 and the layer 125. Rolls 116 and 117 (FIG. 16) guide the web 37 about the drum heater 115. The heating of the layer 125 has some tendency to break down the normally non-conductive nature of the layer 125, but this is not serious because the layer 124 is not broken down or activated by heat from the drum heater 115.

Figure 19:
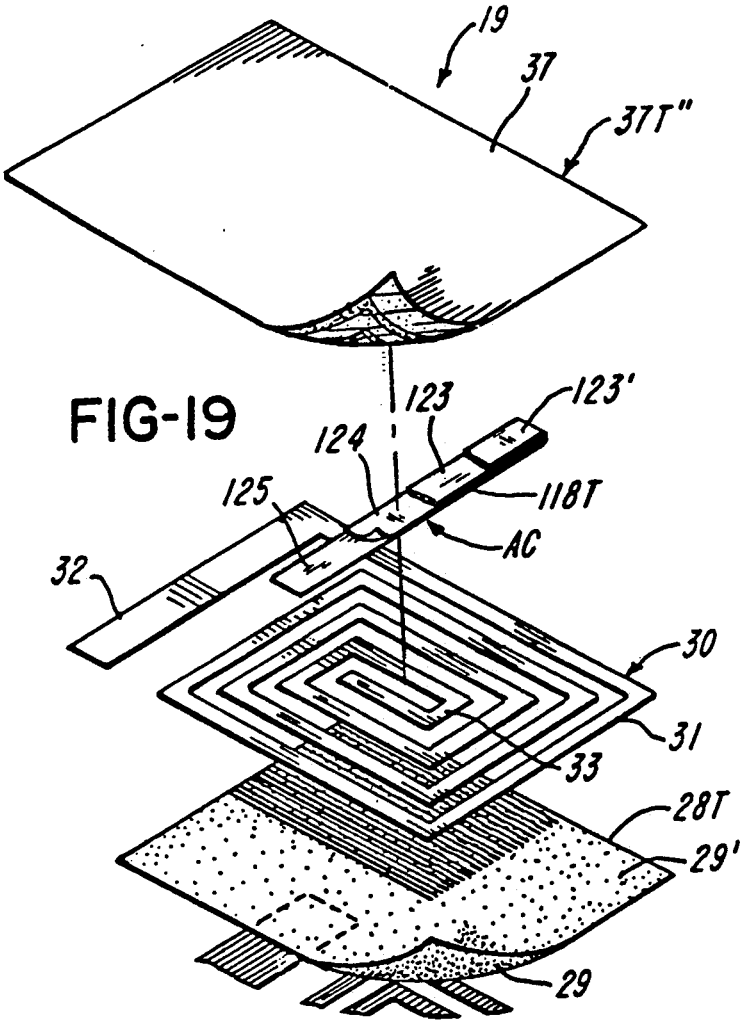
FIG. 19 is a fragmentary perspective view similar to FIG. 14 but showing another embodiment of structure for deactivating the tag.
Figure 20:
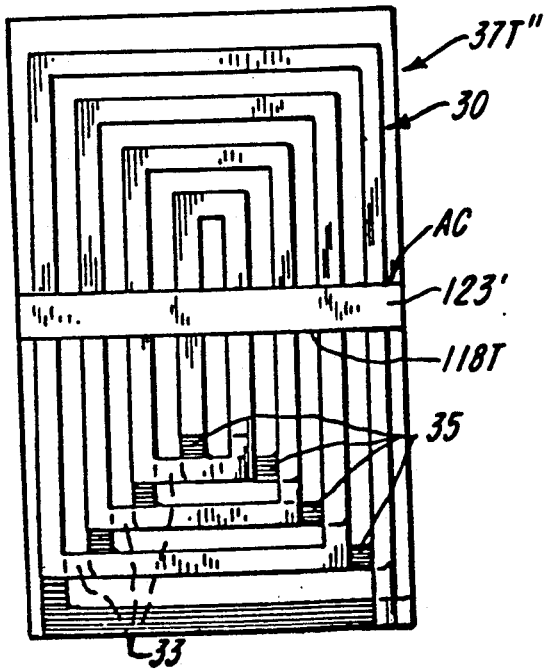
FIG. 20 is a fragmentary top plan view of the tag shown in FIG. 19.

With reference to FIGS. 19 and 20, there is shown a fragment of a finished tag 37T'' with the webs 118 and 119 having been severed so as to be coextensive with the tag 37T'' and is indicated at 118T. The web strip or stripe 118T includes the paper layer 123', the conductive layer or conductor 123 and the normally non-conductive layers 124 and 125. The layers 123, 124 and 125 are shown to be of the same width and comprise an activatable connection AC. Both coatings 124 and 125 electrically isolate the conductor 123 form the conductor spiral 30. In other respects the tag 37T'' is identical to the tag 37T and is made by the same process as depicted for example in FIG. 3.

Figure 21:
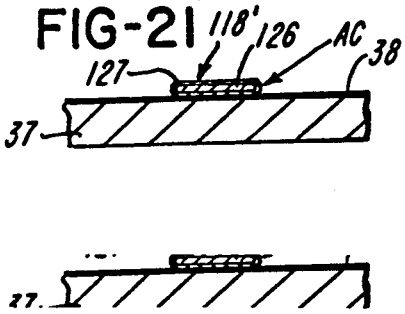
FIG. 21 is a sectional view similar to FIG. 18 but showing an alternative structure for deactivating the tag.

The embodiment of FIG. 21 is identical to the embodiment of FIGS. 16 through 20 except that instead of the webs 118 and 119 there are a pair of webs comprised of flat bands, one of which is shown in FIG. 21 and is depicted at 118'. The band 118' is comprised of a web or band conductor 126 of a conductive material such as copper enclosed in a thin coating of a non-conductive material 127. The band 118' comprises an activatable connection AC. As seen in FIG. 21, the upper surface of the coating 127 electrically isolates the conductor 126 from the conductor spiral 30. The band 118' is processed according to one specific embodiment, by starting with coated motor winding wire, Specification No. 8046 obtained from the Belden Company, Geneva, Ill. 60134 U.S.A. and having a diameter of about 0.004 inch with an insulating coating of about 0.0005, flattening the wire between a pair of rolls into a thin band having a thickness of 0.0006 inch. Thus processed, the insulating coating is weakened to a degree which breaks down when the resulting tag is subjected to a sufficiently high energy level signal. The coating 118' is thus termed a "breakdown coating" because it acts as an insulator when the tag is subjected to an interrogation signal at a first energy level but no longer acts as an electrical insulator when subjected to a sufficiently higher energy level signal. The conductor 126 accordingly acts to short out the inductor 30 at the higher energy level signal.

The embodiments depicted in FIGS. 11 through 20 and described in connection therewith enable the tag 37T' or 37T'' to be detected in an interrogation zone when subjected to a radio frequency signal at or near the resonant frequency of the resonant circuit. By sufficiently increasing the energy level of the signal, the normally non-conductive coating 114 (or 114T), or 124 and 125 becomes conductive to alter the response of the resonant circuit. This is accomplished in a specific embodiment by using a normally non-conductive coating to provide an open short-circuit between different portions of the conductor spiral 30.

When the tag is subjected to a high level of energy, in the embodiments of FIGS. 11 through 15, and 16 through 20 the normally non-conductive coating becomes conductive and shorts out the inductor. Thus, the resonant circuit is no longer able to resonate at the proper frequency and is unable to be detected by the receiver in the interrogation zone.

While the illustrated embodiments disclose the activatable connection AC provided by an additional conductor as extending across all the turns of the conductor spiral 30 and by a normally non-conductive material or breakdown insulation electrically isolating the conductor from the conductor spiral 30 and also extending across all of the turns of the conductor spiral 30, the invention is not to be considered limited thereby.

By way of example, not limitation, examples of the various coatings are stated below:

I. For the embodiment of FIGS. 11 through 15

A. Examples of the normally non-conductive coating 114 are:

| | Parts by Weight |
|---|---|
| Example 1 | |
| cellulose acetate (C.A.) powder (E-398-3) | 60 |
| acetone | 300 |
| Mixing procedure: Solvate C.A. powder in acetone with stirring. | |
| C.A./copper dispersion above C.A. solution (16% T.S.) | 15 |
| copper 8620 powder | 2.5 |
| Mixing procedure: Add copper powder to C.A. solution with adequate stirring to effect a smooth metallic dispersion. | |
| Example 2 | |
| acrylvid B-48N (45% in toluene) | 30 |
| acetone | 20 |

-continued

| | Parts by Weight |
|---|---|
| isopropanol | 3 |
| Above solution (25% T.S.) | 10 |
| copper 8620 powder | 5 |
| Mixing procedure: disperse copper powder into B-48N solution (Percent copper powder is 60–70% on dry weight basis.) | |

B. Examples of the conductive coating 113 are:

| | Parts by Weight |
|---|---|
| Example 1 | |
| acryloid B-67 acrylic (45% in naptha) | 25 |
| naptha | 16 |
| silflake #237 metal powder | 42 |
| Mixing procedure: add metal powder to solvent and wet out. Add solvated acrylic and stir well to disperse. Mix or shake well prior to use. (75% to 85% conductive metal on dry weight basis.) | |
| Example 2 | |
| acryloid NAD-10 (40% in naptha) | 10 |
| silflake #237 metal powder | 20 |
| Mixing procedure: Add metal powder to acrylic dispersion with stirring. | |
| Example 3 | |
| S & V aqueous foil ink OFG 11525 (37% T.S.) | 5 |
| silflake #237 metal powder | 8 |
| Mixing procedure: Add metal powder to aqueous dispersion slowly with adequate agitation to effect a smooth metallic dispersion. | |

II. For the embodiment of FIGS. 16 through 20

A. Examples of the low temperature coating 125 are:

| | Parts by Weight |
|---|---|
| Example 1 | |
| acryloid NAD-10 dispersion (30% T. Solids) | 10 |
| naptha | 2 |
| copper 8620 copper powder | 5 |
| Mixing procedure: wet copper powder with Naptha and disperse completely. Add NAD-10 dispersion slowly with stirring. Mix well or shake before use. | |
| Example 2 | |
| polyester resin (K-1979) | 28 |
| ethanol | 10 |
| isopropanol | 10 |
| ethyl acetate | 20 |
| above polyester solution | 10 |
| copper 8620 powder | 2.5 |
| Mixing procedure: add copper powder to polyester solution while stirring to effect a smooth metallic dispersion. (48% copper powder on dry basis) | |

B. Examples of the high temperature coating 124 are:

| | |
|---|---|
| Example 1 | |
| cellulose acetate butyrate (C.A.B.)(551-0.2) | 40 |

-continued

| | |
|---|---|
| toluene | 115 |
| Ethyl Alcohol | 21 |
| Above C.A.B. solution (22.7%) | 10 |
| toluene | 2 |
| copper 8620 copper powder | 5 |
| Mixing procedure: wet copper powder with solvent and add C.A.B. solution with stirring. | |
| Example 2 | |
| acryloid B-48N (45% in toluene) | 30 |
| acetone | 20 |
| isopropanol | 3 |
| Above solution (25% T.S.) | 10 |
| copper 8620 copper powder (Dry weight basis - copper is 60–70%) | 5 |
| Mixing procedure: add copper powder to above solution with proper agitation to effect a smooth metallic dispersion. | |

The materials used in the above examples are obtainable from the following suppliers:

Acryloid NAD-10, Acryloid B-48N and Acryloid B-67, Rohm & Hass, Philadelphia, Pa.;

Cellulose Acetate (E-398-3) and Cellulose Acetate Butyrate (551-0.2), Eastman Chemical Products, Inc., Kingsport, Tenn.;

Copper 8620, U.S. Bronze, Flemington, N.J.;

Silflake #237, Handy & Harmon, Fairfield, Conn.;

Krumbhaar K-1979, Lawter International, Inc., Northbrook, Ill.;

Aqeuous foil ink OFG 11525, Sinclair & Valentine, St. Paul, Minn.

FIGS. 22 through 25 depict an improved method over the embodiment of FIGS. 11 through 15, over the embodiment of FIGS. 16 through 20, and over the embodiment of FIG. 21. The method of the embodiment of FIGS. 22 through 25 relates to the formation of longitudinally spaced deactivatable resonant circuits arranged in a web. The longitudinal spacing of the resonant circuits assures that electrostatic charge that can prematurely deactivate one resonant circuit in the web cannot arc longitudinally to the other resonant circuits in the web to cause their premature deactivation. Where possible, the same reference character will be used in the embodiment of FIGS. 22 through 25 as in the embodiment of FIGS. 16 through 20 to designate components having the same general construction and function, but increased by 200. It will be appreciated that reference is also made to FIGS. 3, 5 and 6.

With reference initially to FIG. 22, web 249 of planar, electrically conductive material is cut in patterns of conductor spirals 400 and 401. The cut patterns include lateral or transverse lines of complete severing 402. The conductor spirals 400 and 401 are generally similar to the conductor spirals 25 and 30, however, inspection of FIG. 5 will indicate that all conductor spirals 25 and 30 are in very close proximity to each other in the longitudinal direction, being spaced only by knife cuts themselves. In addition, spirals 25 are connected to each other and spirals 30 are connected to each other. In contrast, in the embodiment of FIGS. 22 through 25, only the conductor spirals 400 and 401 between adjacent lines of complete severing 402 are connected to each other. In the method of FIGS. 22 through 25, reference may be had to FIG. 3 which shows that the conductor spiral webs 20 and 37 are separated as they pass partly about roll 66, thereafter dielectric material webs 28*a* and 28*b* are applied, the webs 20 and 37 are shifted longitudinally by the pitch of one conductor spiral 400 (or 401) plus the width of one conductor, and thereafter the webs 20 and 37 are re-laminated as they pass between rolls 86 and 87.

As is evident from FIG. 23, once the web of resonant circuits 401 is stripped away, the resultant web 220 has pairs of resonant circuits 401 that are longitudinally spaced apart. In like manner, the pairs of resonant circuits 400 in the stripped away web (corresponding to the web 37 in FIG. 3), are also spaced apart longitudinally.

The method of the embodiment of FIGS. 22 through 25, relates to production of deactivatable tags. The illustrated arrangement for deactivating the tags utilizes the arrangement taught in the embodiment of FIGS. 16 through 20 with the exception that the deactivator webs 318 and 319 (corresponding to the deactivator webs 118 and 119 in FIG. 16 for example), are separated into longitudinally spaced deactivator strips or stripes 318' and 319'. The separation is accomplished in accordance with the specific embodiment shown in FIG. 24, by punching out portions or holes 407 of the web 238 and the deactivator webs 318 and 319. For this purpose, a diagrammatically illustrated rotary punch 403 and a rotary die 404 are used. The rotary punch 403 has punches 405 and the rotary die 404 has cooperating die holes 406. The resultant holes 407 are wider than the spacing between the resonant circuits. The holes 407 are thus registered with the margins of the longitudinally spaced resonant circuits are shown in FIG. 25. Thus, static electricity cannot arc between resonant circuits in a longitudinal direction and static electricity cannot arc between deactivator strips 318' (or 319').

The invention of the embodiments of FIGS. 26 through 28, and 29 and 30 has applicability in general to tags with resonant circuits with generally spaced but connected conductors. For example, the invention is useful in the embodiments of FIGS. 1 through 10, 11 through 13, 14 through 20, 21 and 22 through 25. The invention is not limited to applications involving a pair of spiral conductors. It is useful for example in resonant circuits where at least one of the conductors is not a spiral. This type of a circuit is shown for example in U.S. Pat. No. 3,913,219. The invention is, however, illustrated with the structure according to the most preferred embodiment of FIGS. 22 through 25.

Figure 26:
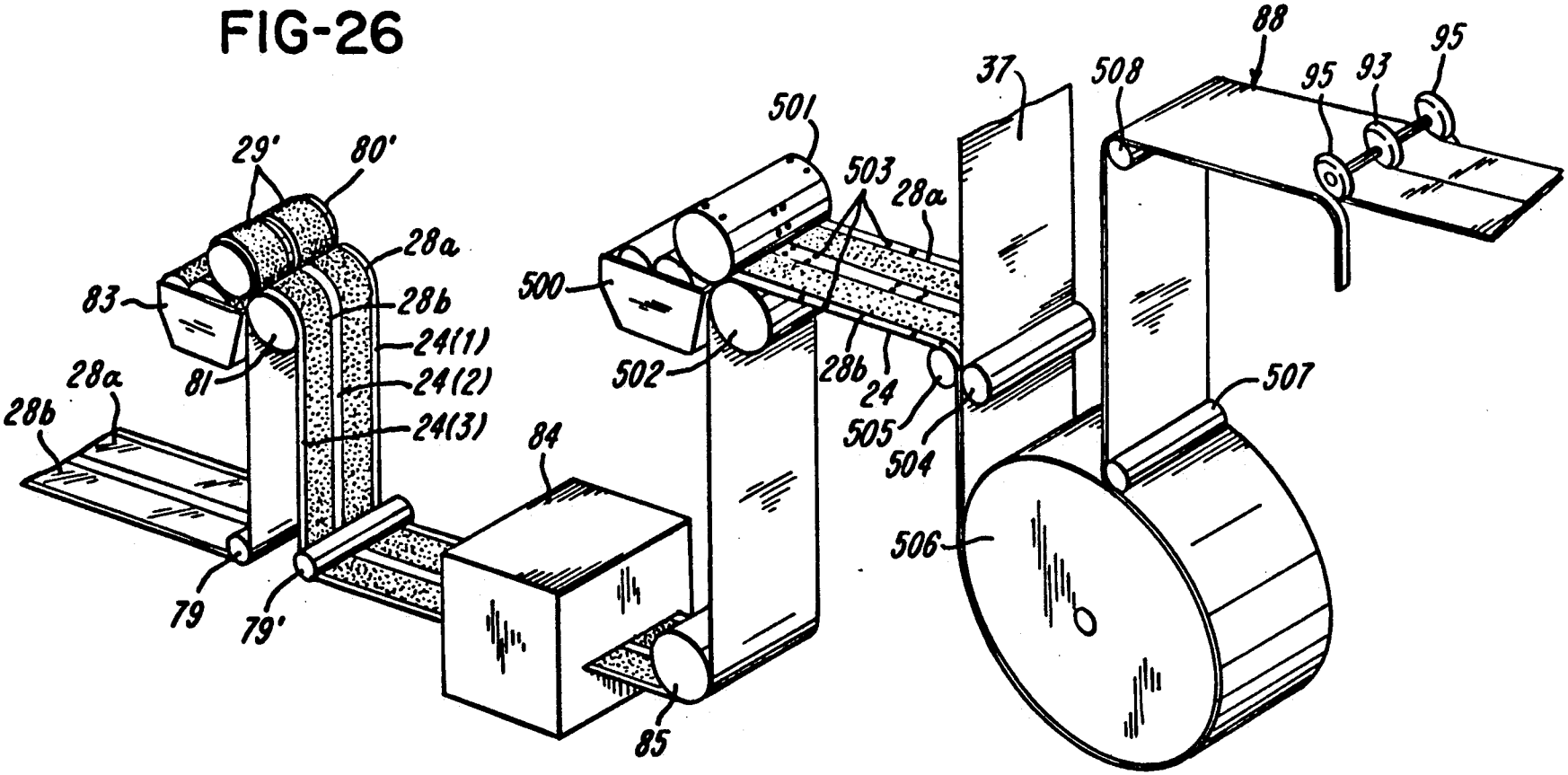
FIG. 26 is a fragmentary, diagrammatic, perspective view showing the portion of a tag making process which incorporates the present invention.
Figure 27:
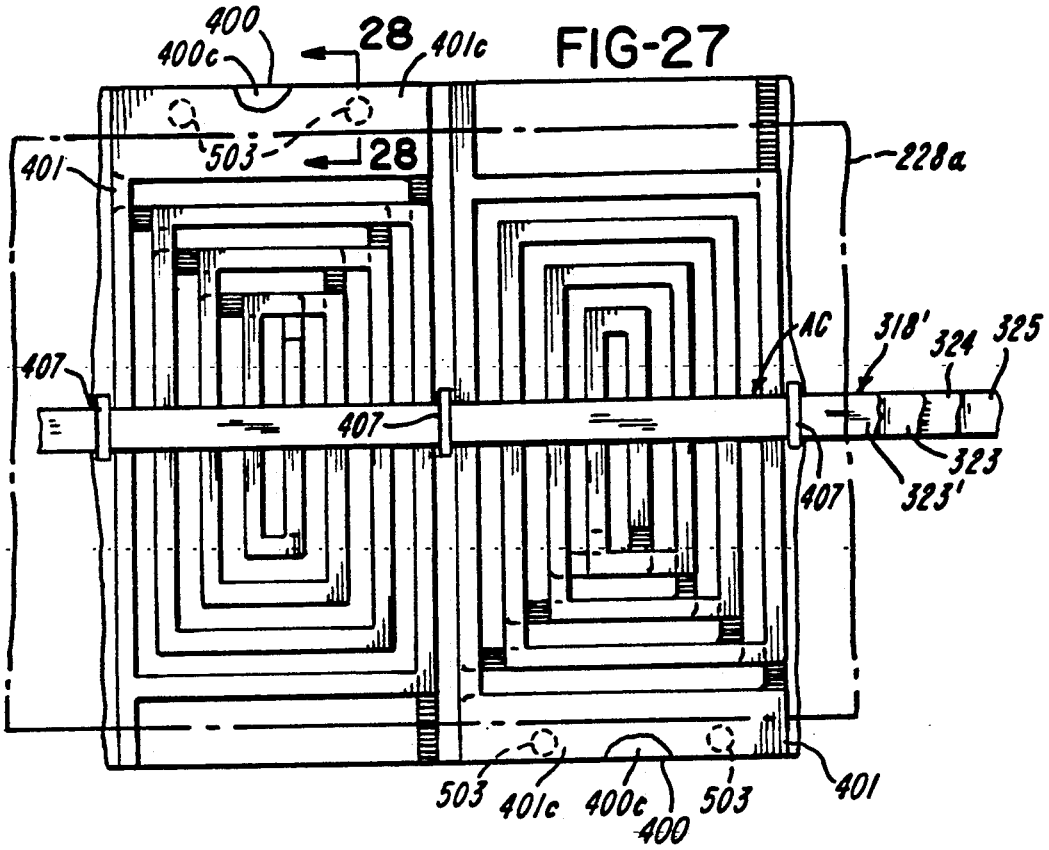
FIG. 27 is a top plan view similar to FIG. 25, but incorporating the invention also illustrated in FIG. 26.
Figure 28:
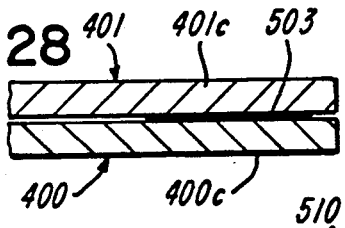
FIG. 28 is a sectional view taken generally along line 28—28 of FIG. 27.
Figure 30:
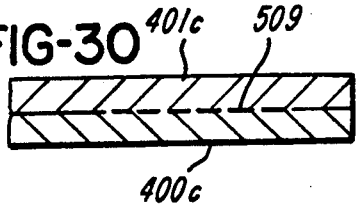
FIG. 30 is a sectional view taken generally along 30—30 of FIG. 29.

With reference initially to FIG. 26, there are illustrated several of the steps in the improved process. It is to be understood that other steps in the process are illustrated in other figures, for example FIGS. 3 and 16. It is seen in FIG. 3 that the roll 71 applies a coating of adhesive 29 fully across the web 24 and that the roll 80 applies a coating of adhesive 29' fully across the dielectric webs 28*a* and 28*b*, but also fully across the exposed portions of the web 24. This means that when the staking occurs as illustrated at 90, the spiked wheels 89 are required to pass through adhesive and also that the spiral conductors are spaced by that adhesive except where the staking occurs. By a construction not shown, and with respect to the embodiments of FIGS. 26 through 28, and 29 and 30, the roll 29 is patterned so it will not apply adhesive to the web 24 except in the path of the dielectric webs 28*a* and 28*b*. Roll 80' is identical to the roll 80 except it is patterned to apply adhesive 29' only to the upper sides of the dielectric webs 28*a* and 28*b* so that portions 24(1), 24(2) and 24(3) of the web 24 are free of adhesive. From there the web 24 and associated webs 28*a* and 28*b* pass through a drier 84 and partly around a roll 85. A fountain 500 has a roll 501 cooperating with a back-up roll 502 to deposit or print a welding material 503 onto the connector portions 400*c* of spiral conductors 400 in a predetermined repetitive pattern. It is preferred that two spaced spots of the welding material 503 be applied to each connector portion 400*c*. As shown, once the welding material 503 has been applied, the web 24 is laminated to the web 37 as they pass between rolls 504 and 505. From there the combined webs 24 and 37 pass partially around and in contact with a drum heater 506 and from there partially about rolls 507 and 508 to slitters 93 and 95. From there the tag web 89 can be acted upon by transverse cutter 96 and the resulting narrow webs rolled into individual rolls. The drum heater 506 causes the connector portions 400*c* and 401*c* to be welded to each other to make good electrical connection. The expression "welding" as used herein includes what is sometimes referred to as "soldering". The heater 506 heats the welding material to the temperature where it fuses to the connector portions 400 and 401 to each other but below the temperature where the resonant circuit is degraded or where the activatable connection AC causes deactivation of the resonant circuit. By way of example, not limitation, the welding material fuses at 96° C. and the breakdown coating 114 for example breaks down at 103° C. The welding material is comprised of 80% by weight of metal alloy and of 20% by weight of flux and is designated BI 52 PRMAA4 and sold by Multicore Solders Inc., Cantiague Rock Road, Westbury N.Y. 11590. The metal alloy contains 15% tin, 33% lead and 52% bismuth. The 20% by weight of flux comprises 10.3% resin, 8.4% glycol, 0.3% activators and 1.0% gelling agent.

Figure 29:
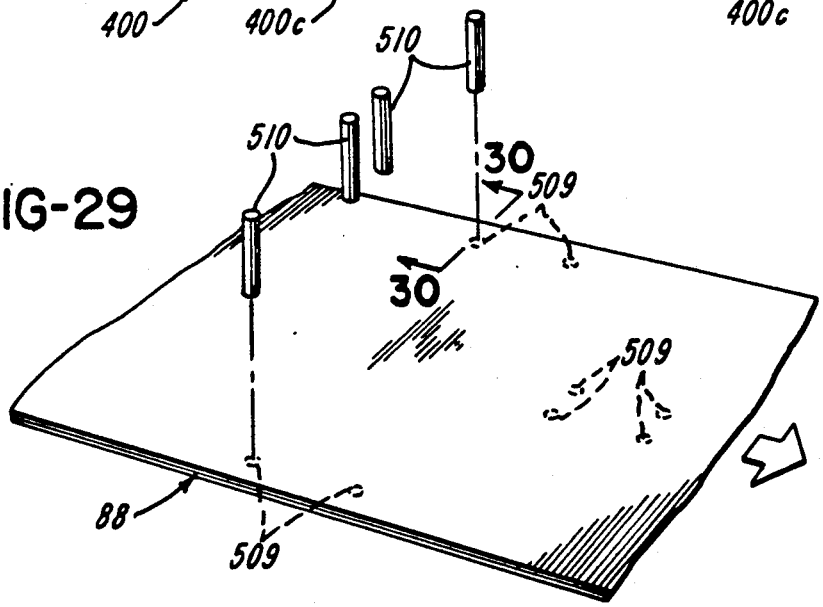
FIG. 29 is a fragmentary perspective view showing an alternative arrangement for welding the spiral conductors to each other.

In an alternative embodiment, the tags can be made as illustrated for example in FIGS. 3 and 16 except instead of applying the welding material 503, the connector portions 400C and 401C are connected by welding using localized heat to bring the temperature of the connector portions 400 and 401 to the melting point. The resulting weld is shown at 509. This can be accomplished for example by a laser beam. Laser guns 510 illustrated in FIG. 29 are operated to effect the welds 509.

Figure 31:
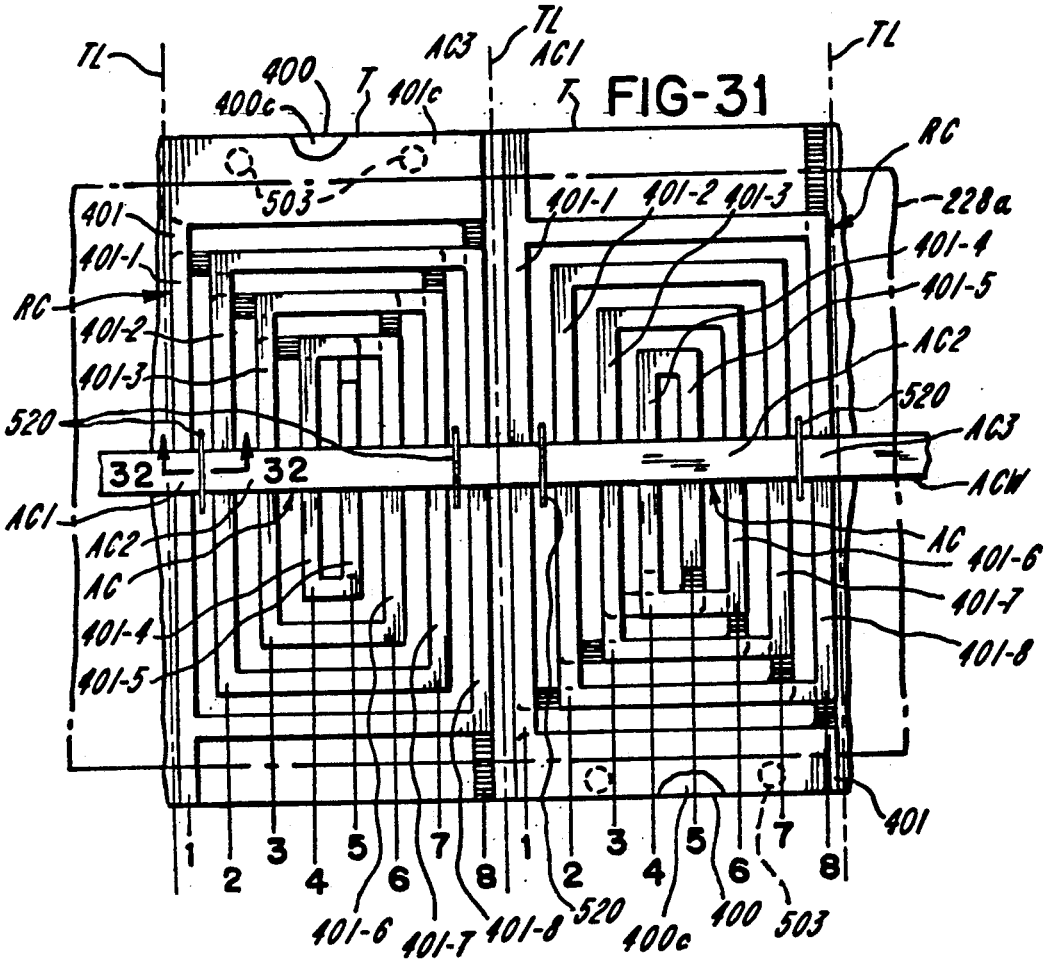
FIG. 31 is a top plan view similar to FIG. 27 but incorporating the invention also shown in FIGS. 32 and 33.

The present invention constitutes an improvement over prior art deactivation techniques. With reference to FIG. 31, resonant circuits RC formed of connected pairs of spiral conductors 400 and 401 having plural turns are shown provided with an activatable connection or deactivator AC. The deactivators AC shown in FIG. 31 as made from a deactivator web ACW. In the manufacture of the tag web shown in FIG. 31, the deactivator web ACW is cut as shown at 520. Each cut 520 is more than a slit because it causes permanent spacing or separation between portions or sections or strips AC1, AC2 and AC3 associated with each tag T. As shown, each tag T comprises the portion of the tag web between adjacent pairs of phantom lines TL. The section AC1 extends between one end of the tag T along one phantom line TL and a cut 520, the section AC2 extends between adjacent but spaced cuts 520 of a tag T, and the section AC3 extends between the other cut 520 in the tag T and the other end of the tag T along the other phantom line TL.

Figure 32:
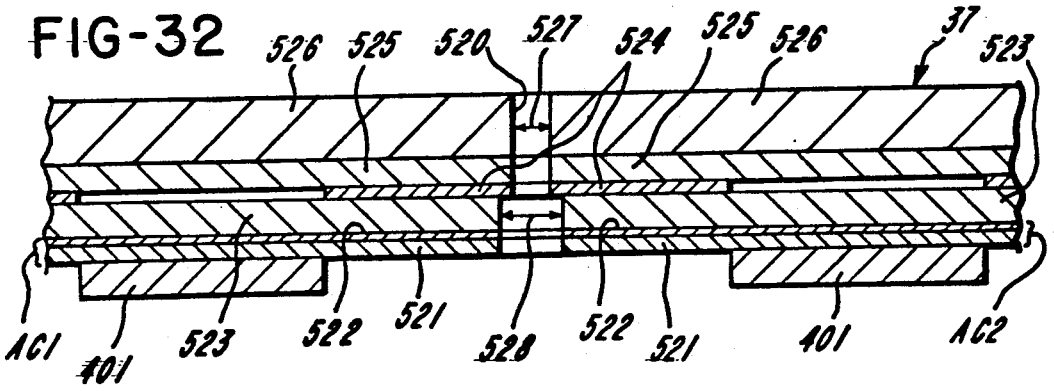
FIG. 32 is a sectional view taken generally along line 32—32 of FIG. 31, but FIG. 32 shows structure above the deactivator and omits structure below the upper turn of the resonant circuit.

FIG. 32 shows the upper spiral conductor 401. The deactivator web ACW is comprised of normally non-conductive or breakdown material 521 preferably the same as the low temperature layer or coating 125, Example 1, used in connection with the embodiment of FIGS. 16 through 20. The breakdown material 521 is in proximity to and, more particularly, in contact with the spiral conductor 401. The deactivator web ACW is also comprised of a deactivating conductor in the form of a vacuum metalized coating 522 of aluminum to which the normally non-conductive breakdown material 521 is adhered. The coating or layer 522 is deposited on a polyester film 523 which acts as a carrier or support for the coating 522 and the breakdown material 521. A mask pattern 524 (corresponding to mask pattern 23) is disposed between the film 523 and an adhesive coating 525 on a polyester film 526. The cuts 520 are identical and one of the cuts 520 is shown in detail in FIG. 32. The cut 520 in FIG. 32 is shown to have two widths for a reason as will be evident from the description in connection with FIG. 33.

The upper spiral conductor 401 has eight conductor portions 401-1 through 401-8 at first through eighth locations numbered 1 through 8. In the preferred embodiment, one cut 520 is spaced between the first and second conductor portions 401-1 and 401-2, that is, between the first and second locations and another cut 520 is spaced between the seventh and eighth conductor portions 401-7 and 401-8 between the seventh and eighth locations. The cuts 520 effectively make section AC2 the deactivator AC. It is evident that the deactivator AC is adjacent and crosses less than all the turns of the spiral conductor 401. When the deactivator AC is operated, the breakdown coating 521 at one or more locations 1 through 8 becomes conductive and consequently the deactivating conductor 522 becomes electrically connected to the resonant circuit at the location or locations 1 through 8 where breakdown occurs. If there is breakdown at only one location, the conductor 522 acts like a spur electrically connected to the spiral conductor 401 and thus affects the resonant circuit. However, breakdown can also occur at two or more locations, second through seventh, which will electrically connect portions of the spiral conductor 401 to each other to prevent detection of the resonant circuit RC of the tag.

It has been found that there is even considerable improvement in deactivation when a cut 520 is made through the deactivator web ACW only between the first and second conductor portions 401-1 and 401-2 or only between the seventh and eighth conductor portions 401-7 and 401-8. In this case there is only one cut 520 in the deactivator web in each tag. Accordingly, the deactivator strip in each tag is separated into two deactivator sections or deactivator strips.

Unlike prior art developments referred to above, the use of the coating 522 results in an unexpected improvement of the Q of the resonant circuit because the coating 522 provides very little shielding of the resonant circuit. The coating 522 in its preferred embodiment is only about 135 Angstom Units thick. Specifically, the prior art tag having a deactivator AC according to FIG. 19 of U.S. Pat. No. 4,818,312 has a circuit Q of about 50. With the present invention the circuit Q is boosted to about 62, which is a surprising improvement. The circuit Q of that prior art tag without any deactivator AC is about 65.

Figure 33:
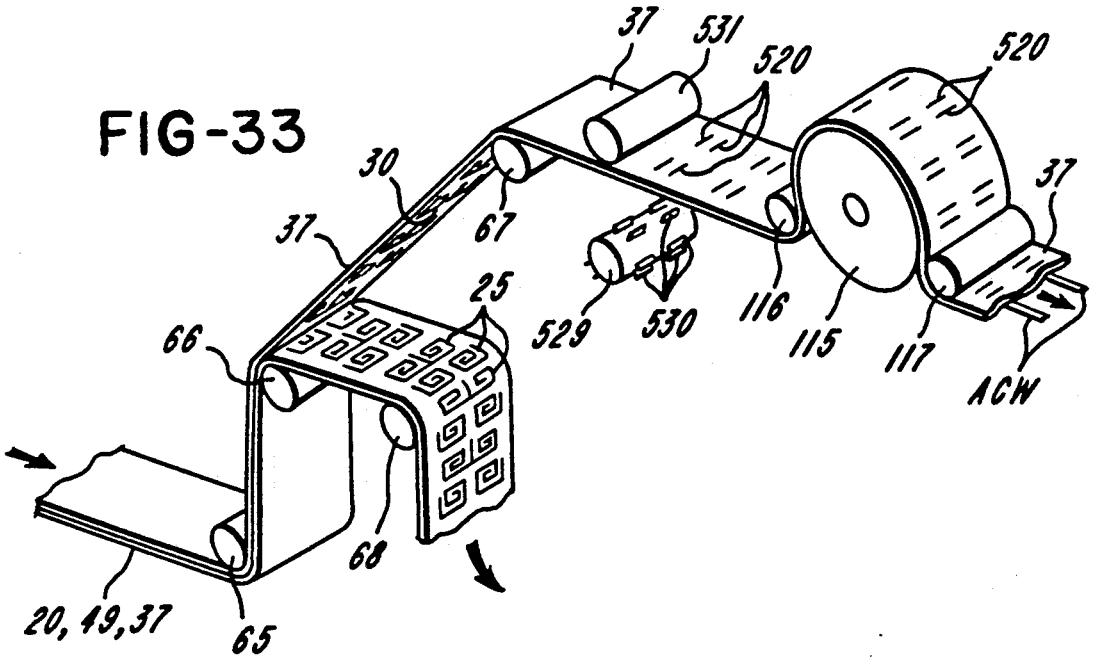
FIG. 33 is a view similar to FIG. 16 but showing how a tag embodying the invention is made.

Referring to FIG. 33, there is diagrammatically illustrated a portion of the improved process for making the tags T shown in FIGS. 31 and 32. The present invention adds to the disclosure of FIG. 16 the provision of a cutter roll 529 having cutter blades 530 which produce the cuts 520 in the deactivator web ACW. The web 37 passes between the cutter roll 529 and a back-up roll 531. It should be borne in mind that the web 37 is under tension as it is drawn partially about rolls 67 and 116, heated drum 115 and roll 117. The deactivator web has been severed into sections AC1, AC2 and AC3, which are no longer in tension and therefore are free to shrink. The deactivator sections AC1, AC2 and AC3 are not under tension and consequently they do not stretch along with the web 37. Specifically, with reference to FIG. 32, the resulting cut opening 527 in the polyester film 526 the associated adhesive 525 and pattern 524 are narrower than the cut opening 528 in the deactivator AC and its associated supporting or carrier web 523.

It should be noted that the cuts 520 also have the effect of preventing premature deactivation in the tag manufacturing equipment or subsequently in printing equipment due to electrostatic discharge.

The vacuum metalized or sputtered coating 522 is illustrated to be relatively thick in FIG. 32 for clarity, although it is substantially thinner than illustrated. In addition, there is some contact of the adhesive 524 with the film 523, although this is not illustrated.

The coating 521 is preferably less than 0.000002 mm in thickness. By way of example, not limitation, the film 526 is about 0.002 inch (0.051 mm) thick, the adhesive 525 is about 0.0007 inch (0.018 mm) thick, the mask pattern 524 is about 0.0001 inch (0.0025 mm) thick, the coating 521 is about 135 Angstom Units thick, the breakdown coating 522 is about 0.0004 inch (0.010 mm) thick, and the spiral conductor 401 is about 0.001 inch (0.025 mm) thick.

Other embodiments and modifications of the invention will suggest themselves to those skilled in the art, and all such of these as come within the spirit of the invention are included within its scope as best defined by the appended claims.

What is claimed is:

1. Method of promoting the permanent deactivation of tags useable in an electronic article surveillance system, comprising the steps of: providing a resonant circuit detectable at a first energy level, the resonant circuit including a spiral conductor having a plurality of conductor portions, positioning a deactivator across and adjacent at least some of the conductor portions, the deactivator including a deactivating conductor and a normally non-conductive breakdown coating with the deactivator being normally responsive to energy applied to the resonant circuit at a second energy level higher than the first energy level for electrically connecting at least two conductor portions to the deactivating conductor, but inhibiting deactivation of the resonant circuit until energy at a third energy level higher than the second energy level is applied to the resonant circuit.

2. Method as defined in claim 1, wherein the deactivator comprises a deactivator strip disposed adjacent a series of first through eighth spaced conductor portions of the spiral conductor, and wherein the inhibiting step includes providing a discontinuity in the deactivator strip between the first and second conductor portions.

3. Method as defined in claim 1, wherein the deactivator comprises a deactivator strip disposed adjacent a series of first through eighth spaced conductor portions of the spiral conductor, and wherein the inhibiting step includes providing a discontinuity in the strip between the first and second conductor portions and between the seventh and eighth conductor portions.

4. Method of promoting the permanent deactivation of tags useable in an electronic article surveillance system, comprising the steps of: providing a resonant circuit detectable at a first energy level, providing a deactivator adjacent the resonant circuit for normally deactivating the resonant circuit when energy at a second energy level higher than the first energy level is applied to the resonant circuit, but inhibiting the deactivation of the resonant circuit until a third energy level higher than the second energy level is applied to the resonant circuit.

5. A tag for use in an electronic article surveillance system, the tag comprising: a resonant circuit detectable at a first energy level, the resonant circuit including a spiral conductor having a plurality of conductor portions, a deactivator strip extending across and adjacent at least some of the turns, the deactivator strip having a conductor strip and a breakdown coating on the conductor strip and normally responsive to energy applied to the resonant circuit at a second energy level higher than the first energy level for electrically connecting at least two conductor portions to the conductor strip, and means for inhibiting the breakdown coating from deactivating the resonant circuit until energy at a third energy level higher than the second energy level is applied to the resonant circuit.

6. A tag as defined in claim 5, wherein the inhibiting means includes one or more cuts which sever the deactivator strip into two or more spaced sections.

7. A tag as defined in claim 5, wherein the inhibiting means includes two cuts which sever the deactivator strip into three spaced sections.

8. A tag as defined in claim 5, wherein the spiral conductor has a series of first through eighth conductor portions arranged along a linear path, and wherein the inhibiting means includes a separating cut through the deactivator strip between the first and second portions.

9. A tag as defined in claim 5, wherein the spiral conductor has a series of first through eighth conductor portions arranged along a linear path, and wherein the inhibiting means includes a separating cut through the deactivator strip between the first and second conductor portions and between the seventh and eighth conductor portions.

10. A tag for use in an electronic article surveillance system, the tag comprising: a resonant circuit detectable at a first energy level, a deactivator including a deactivator strip adjacent the resonant circuit for normally deactivating the resonant circuit when energy at a second energy level higher than the first energy level is applied to the resonant circuit, and means for inhibiting the deactivator strip from deactivating the resonant circuit until a third energy level higher than the second energy level is applied to the resonant circuit.

11. A tag for use in an electronic article surveillance system, the tag comprising: a resonant circuit detectable at a first energy level, the resonant circuit including a spiral conductor having a plurality of turns, a deactivator including normally non-conductive breakdown material adjacent the resonant circuit for deactivating the resonant circuit when energy at an energy level higher than the first energy level is applied to the resonant circuit, and wherein the deactivator is adjacent less than all of the turns.

12. A web of tags for use in an electronic article surveillance system, the tag comprising: a series of resonant circuits each of which is detectable at a first energy level, each resonant circuit including a spiral conductor having a plurality of turns, a deactivator including a web having deactivator material extending across and adjacent the turns of each circuit, and means for separating the deactivator material of each circuit into at least two sections to prevent the circuit from being deactivated at too low an energy level.

13. A tag for use in an electronic article surveillance system, the tag comprising: a detectable resonant circuit, a deactivator adjacent the resonant circuit, the deactivator including a deactivator strip having a normally non-conductive breakdown material, and means for separating the deactivator strip into at least two spaced sections to minimize premature deactivation of the resonant circuit by the deactivator due to electrostatic discharge.

14. A tag for use in an electronic article surveillance system, the tag comprising: a detectable resonant circuit including a spiral conductor having turns, a deactivator adjacent the spiral conductor, the deactivator including a deactivator strip having a normally non-conductive breakdown material, and means for separating deactivator strip into spaced sections within the periphery of the spiral conductor to minimize premature deactivation of the resonant circuit by the deactivator due to electrostatic discharge.

15. A tag as defined in claim 14, wherein the separating means separates the deactivator strip into sections between at least one pair of adjacent turns.

16. A web of tags, the tags being useable in an electronic article surveillance system, each tag comprising: a detectable resonant circuit having a periphery, a deactivator adjacent the resonant circuit, and means disposed within the periphery of the resonant circuit for minimizing premature deactivation of the resonant circuit by the deactivator due to electrostatic discharge.

17. A tag for use in an electronic article surveillance system, the tag comprising: a detectable resonant circuit, a deactivator for deactivating the resonant circuit, wherein the deactivator includes a composite strip having a conductive layer, a carrier for the conductive layer and a normally non-conductive layer adhered to the conductive layer, the deactivator being positioned in proximity to the resonant circuit so that the normally non-conductive layer becomes conductive to deactivate the resonant circuit when excess energy is applied, wherein the conductive layer comprises a vacuum metalized or sputtered conductive coating on the carrier, and wherein the vacuum metalized or sputtered coating is approximately 135 Angstrom Units in thickness.

18. A tag for use in an electronic article surveillance system, the tag comprising: a detectable resonant circuit, a deactivator for deactivating the resonant circuit, wherein the deactivator includes a composite strip having a conductive layer, a carrier for the conductive layer and a normally non-conductive layer adhered to the conductive layer, the deactivator being positioned in proximity to the resonant circuit so that the normally non-conductive layer becomes conductive to deactivate the resonant circuit when excess energy is applied, wherein the conductive layer comprises a vacuum metalized or sputtered conductive coating on the carrier, and wherein the coating is less than 0.000002 mm thick.

* * * * *

UNITED STATES PATENT AND TRADEMARK OFFICE

CERTIFICATE OF CORRECTION

PATENT NO. : 5,006,856

DATED : April 9, 1991

INVENTOR(S) : S. Eugene Benge and Robert L. Froning

It is certified that error appears in the above-identified patent and that said Letters Patent is hereby corrected as shown below:

Column 16, line 25, after "separating" --the-- has been omitted.

Signed and Sealed this

First Day of December, 1992

*Attest:*

DOUGLAS B. COMER

*Attesting Officer*

*Acting Commissioner of Patents and Trademarks*